United States Patent [19]

Marcotte et al.

[11] Patent Number: 4,697,530

[45] Date of Patent: Oct. 6, 1987

[54] UNDERFED STOKER BOILER FOR BURNING BITUMINOUS COAL AND OTHER SOLID FUEL PARTICLES

[75] Inventors: Richard P. Marcotte; John W. Dumont, Jr., both of Monmouth, Me.

[73] Assignee: Dumont Holding Company, Monmouth, Me.

[21] Appl. No.: 945,494

[22] Filed: Dec. 23, 1986

[51] Int. Cl.[4] ..... F23B 7/00

[52] U.S. Cl. ..... 110/234; 110/101 C; 110/188; 110/270; 110/328; 198/850; 198/853; 236/14; 236/15 BA

[58] Field of Search ..... 110/328, 329, 330, 269, 110/270, 274, 101 C, 186, 190, 188, 234; 198/850, 851, 852, 853; 236/15 BA, 15 E, 14

[56] References Cited

U.S. PATENT DOCUMENTS

| | | | |
|---|---|---|---|
| 2,666,404 | 1/1954 | Kessler | 110/329 |
| 3,868,011 | 2/1975 | Janzen et al. | 198/853 |
| 4,263,857 | 4/1981 | Ban | 110/270 |
| 4,362,269 | 12/1982 | Rastogi et al. | 110/188 X |
| 4,389,980 | 6/1983 | Marcotte et al. | 122/114 |
| 4,648,329 | 3/1987 | Couarc'h et al. | 110/270 X |

OTHER PUBLICATIONS

Technical Bulletin: Jan. 24, 1984, Re: Automatic Packaged Stoker Boiler, Dumont Industries.

*Primary Examiner*—Edward G. Favors
*Attorney, Agent, or Firm*—Abbott Spear

[57] ABSTRACT

An automatic stoker boiler has a heat transfer compartment above a combustion chamber which is divided by a horizontal partition inclined upwardly from the rear end of the boiler towards but terminating short of the front end thereof to provide a restricted port between the thus established upper and lower portions. An endless link belt establishes the lower portion of the combustion chamber and hot gas conduits extend from the upper portion through the heat transfer compartment to the exhaust and which is provided with a draft inducing fan and adjustable damper. Underfire air under the control of an adjustable damper is introduced into the lower portion of the combustion chamber upwardly through the belt and air jets are delivered into the combustion chamber through the front end both above and below the port. A standby fluid fuel burner is located in the rear end of the upper chamber portion. A control, a computerized microprocessor, is provided to ensure the appropriate adjustments of the rate of belt travel, the supply of solid fuel particles delivered thereto, the induced draft and underfire air volume to ensure optimum burning and safe operating conditions in relation to wanted temperatures for space or process heating.

43 Claims, 29 Drawing Figures

30
55
57
42
49
28B
31
32A
28A
48
56B
52
54
32
44
46
43
5
47
28C
45
6
7
62A
62B
32B
53
67
41
61
66B
69
29
61A
62
69A
65
63
64
63A 11B
11B
11C
11C
90
91
82
78
79
83
27
90A
83E
85
83B
83A
71A
71

NOTE:
CIRCLED NUMBERS REPRESENT A COMPUTER TIE IN TO INDICATED CHANNEL.

UNDERFED STOKER BOILER FOR BURNING BITUMINOUS COAL AND OTHER SOLID FUEL PARTICLES

BACKGROUND OF THE INVENTION

Bituminous coal, while having the advantage of plentiful supplies, low ash and low sulphur content, stable prices and high BTU value, is not well suited for use in conventional underfed stoker boilers fueled with anthracite coal.

Bituminous coal has its own peculiar characteristics that renders its use in such boilers less satisfactory than anthracite. This is due to the fact that the volatiles of bituminous coal are higher than those of anthracite while its fixed carbons are lower. The volatiles of bituminous coal ignite readily but if not subject to an appropriate combustion temperature and a sufficient amount of combustion air, a drop in the BTU output and a smokey fire are objectionable consequences so that the advantages of bituminous coal cannot be realized in conventional underfed stoker boilers.

THE PRESENT INVENTION

The general objective of the present invention is to provide underfed stoker boilers adapted not only to burn bituminous coal efficiently but also capable of being readily adjusted to enable anthracite and other biomass particles or combinations of such fuels to be utilized with corresponding efficiency.

In accordance with the invention this objective is attained with underfed boilers which ensure that fuel combustion is attended by adequate combustion air and an appropriate induced draft, adequate time for the envolved chemical reactions to occur and sufficient turbulence tc ensure the combustion of volatiles and the appropriate operating conditions.

In accordance with one aspect of the invention, the boiler consists of a combustion chamber divided by a transverse partition extending from the rear end of the boiler forwardly and upwardly towards but terminating short of the front end thereof to provide a flame and hot gas port effecting communication between the thus established lower and upper portions of the combustion chamber. Heat transfer conduits extend from said upper portion through a heat exchange compartment and are connected to an exhaust. The heat exchange compartment has a water inlet and an outlet for steam or hot water. An endless metal link belt establishes the bottom of the lower portion of the combustion chamber and the belt drive is of a type enabling its rate of travel to be adjusted. Solid fuel particles are fed at an adjustable rate onto the infeed end of the upper course of the belt and damper controlled, underfire air is introduced upwardly through the belt. The exhaust from the heat exchange compartment is connected to a stack and is equipped with a draft inducing fan and an adjustable damper enabling a wanted negative pressure to be established and maintained in the upper portion of the combustion chamber. Overfire air is delivered into the combustion chamber by two sets of jets, one set arranged to ensure turbulence below the port adjacent the front of the lower portion of the combustion chamber and the other set located to provide adequate combustion air in the upper portion thereof.

A previous test boiler had a combustion chamber divided by a horizontal transverse partition into upper and lower portions and establishing a restricted port at the front of the chamber and was provided with an endless belt which was inclined upwardly towards the rear of the lower portion of the combustion chamber. Overfire air was delivered by jets into the front end of the lower portion of the combustion chamber. That boiler, the subject of a limited publication, failed to meet the above general objectives although having advantageous features incorporated in the later detailed preferred embodiment of the present invention.

In another aspect of the invention, a control for the above or any other underfire stoker boiler is operable to provide that relationship between air and fuel supplies to and through the combustion chamber that maximizes efficiency in the burning of the fuels in relation to wanted temperatures for space or process heating and also ensures safe operating conditions.

In another aspect of the invention, a link belt for an underfire stoker boiler is provided which consists of two types of links, one type, drive links and the other type, plain links, all links of the same length. Each link has a central projection at one side, slightly greater than the width of the remainder of that link. The drive links differ from the plain links in that they have teeth at their ends for meshing engagement with beltsupporting sprockets. In practice, the maximum width of the drive links is slightly more than twice that of the plain links. The links are arranged in alternating first and second groups with each group containing drive links and plain links. In each group, the projections are disposed in the same direction with those of the first groups disposed oppositely to those of the second groups so that their projections form gaps freely receptive of the ends of the links adjacent second groups providing narrow passages for underfire air which serves to clear the passages of ashes. The base of the underfire stoker boiler has transverse drive and driven shafts with each shaft supporting a plurality of sprockets and the links of both groups are so arranged that corresponding drive links engage the same sprockets.

In yet another aspect of the invention, the drive links are so spaced that damper controlled, lengthwise plenums for underfire air may be provided in the spaces between their teeth and with the plenums in communication with the air passageways through the upper course of the belt. Each plenum includes members which serve to support the upper course of the belt.

A further important feature of the present invention is that belt travel is effected by means operated by fluid under pressure and enables the advance of the belt to be by fixed increments. The frequency at which such means is operated determines the rate of belt travel.

Another objective of the invention is to ensure that the fuel feed to as well as through the combustion chamber is adjustable whatever the means are that are employed for that purpose. All such means typically have a first, relatively small supply of fuel from which fuel is removed or received as the fuel conveying means advances and which is replenished by transferring fuel thereto from a hopper of substantially larger capacity. In accordance with the invention, such transfer is effected by a conveyor of the screw type powered by a hydraulic motor operated for short intervals, typically less than ten seconds and depending on the type of fuel thus to deliver small quantities of fuel to the belt. The rate of fuel feeding depends on the frequency with which the hydraulic motor is placed in service.

An important objective of the invention is that of providing for the adjustments of underfire air volumes, the adjustments of the induced draft, and the adjustments of the fuel feed rates to and through the combustion chamber by predetermined, proportional increments. To that end, a hydraulic circuit includes an actuator to operate the underfire air damper between limits, a like circuit to operate the damper controlling the induced draft, a circuit which includes the fluid pressure operating means by which the belt is advanced and a circuit including the motor by which the hopper-to-fuel chute feed is operated. Each such circuit is controlled by solenoid operated valves enabling the controlled actuators, piston cylinder unit and motor and hence the devices operated thereby to be so operated as to effect their predetermined incremental operation.

As the boiler temperature or pressure change as do indoor and outdoor temperatures and their relation to the temperature wanted for space or process heating, boiler efficiency requires that adjustments in the underfire air volume, fuel feed rates to and through the combustion chamber and adjustments of the induced draft must be made in the appropriate direction and to the necessary extent in response to any such change or changes.

An important objective of the invention is, accordingly, to provide, as the operating control of the boiler, a computerized, digital and analog microprocessor programmed to carry out the following basic functions as well as various other functions to be detailed later for each particular fuel or fuel combinations. To that end, with an established fire, if the boiler temperature or pressure is too high, the fuel feed rate through the combustion chamber is reduced by a predetermined increment, the volume of underfire air is reduced by a proportional increment, the fuel feed rate to the boiler is reduced by a proportional increment and the induced draft is changed by a predetermined proportional increment.

This procedure continues until the combustion rate has been so altered that the boiler temperature or pressure has been appropriately reduced and then, if heat is required for space or process heating, steam or hot water is delivered for such purposes and the above program is continued either to increase the combustion rate or to reduce it by proportional increments thus to maintain combustion efficiency and the maintenance of a wanted temperature for space or process heating.

It is preferred that an additional sensing means be employed in the exhaust to detect the presence of carbon monoxide or oxygen as such indicates imperfect combustion conditions and in response to such detection to effect adjustments in the underfire air volume by increments that are smaller than those previously referred to in connection with underfire air volume control. The computerized microprocessor is programmed to effect such smaller increments.

Another aspect of the invention is that of providing for standby use of a conventional oil or gas burner mounted in the upper portion of the combustion chamber and provided with conventional controls. Should the solid fuel fire die out, the computerized microprocessor, after checking to ensure that the fire is out, shuts down the hydraulic system and the blower employed for underfire air delivery but leaves the induced draft fan in operation. In embodiments of the invention where overfire air is delivered into the combustion chamber, the delivery of overfire air is also terminated.

Other novel features and advantages of the present invention and the manner of their attainment will be apparent from the accompanying description of the preferred embodiment and the appended claims.

BRIEF DESCRIPTION OF THE DRAWINGS

The accompanying drawings illustrate a preferred embodiment of a stoker boiler in accordance with the invention

THE PREFERRED EMBODIMENT OF THE INVENTION

Figure 1:
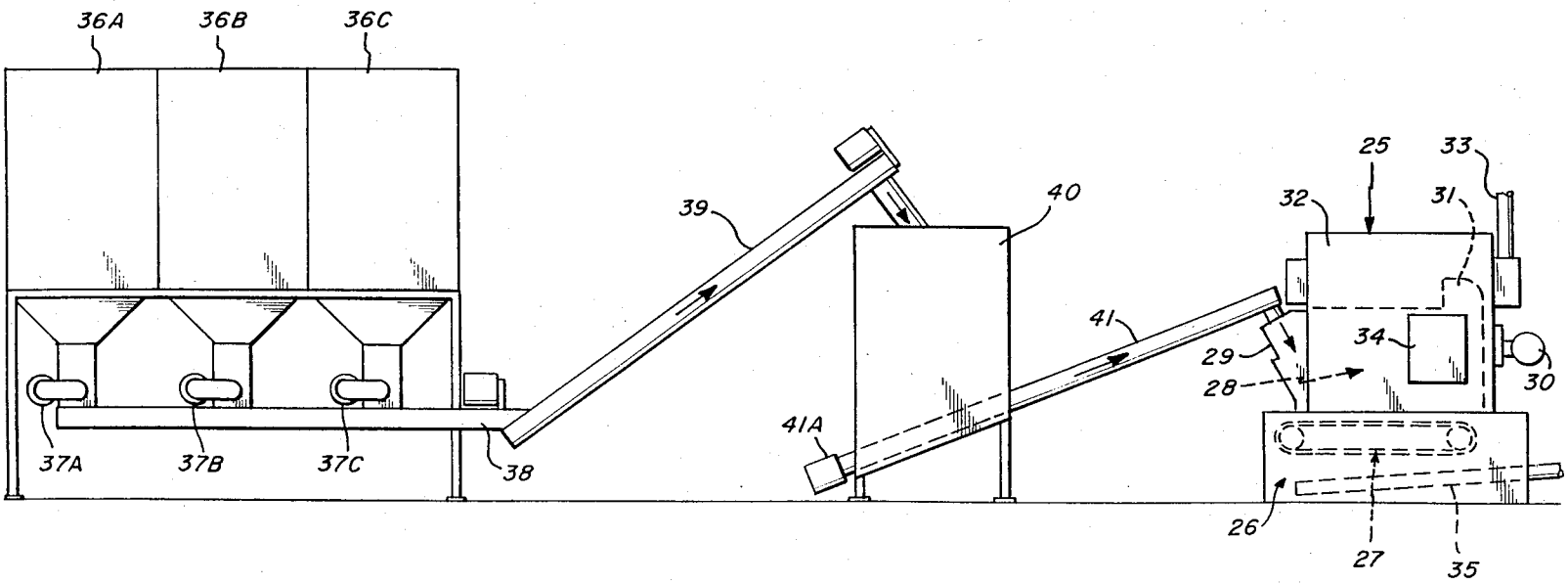
FIG. 1 is a somewhat schematic illustration of a typical installation thereof.

Reference is first made to FIG. 1 illustrating a typical installation of a boiler and associated fuel storage and fuel feed systems.

The boiler, generally indicated at 25 has a base 26 provided with an endless link belt, generally indicated at 27 extending lengthwise of the bottom of the refractory lined combustion chamber, generally indicated at 28. The combustion chamber has a solid fuel feed chute 29 at the front end of the boiler, a standby oil or gas burner 30 at the rear end thereof and a throat 31 at the rear of the heat exchanging compartment, generally indicated at 32 which is provided with an exhaust 33. The computerized microprocessor in control of the operation of the boiler 25, the fuel feed system and other functions is generally indicated at 34. A conveyor 35, positioned to carry ashes from the base 27 represents but one way to effect that operation.

The fuel feed system is shown as having a solid fuel bunker provided with sections 36A, 36B, and 36C for three types of solid fuel particles with the sections having discharge controls 37A, 37B, and 37C, respectively, of a type which can be operated automatically from a remote station and by which any one of the three solid fuels or combinations thereof may be discharged, when needed, on a conveyor 38 which supplies a fuel feed screw 39 which discharges the selected fuel or fuel combination into a hopper 40. Fuel from the hopper 40 is fed, as needed, to the chute 29 by a feed screw 41 driven by a hydraulic motor 41A. By way of example and not of limitation, the bunker sections 36A and 36C may be respectively, for bituminous and anthracite coal while the bunker section 36B may be for wood chips which when mixed with coal provides moisture to enhance the burning thereof. The bunker discharge controls, the conveyor 38 and the feed screws 29 and 41 are conventional and are not detailed nor are the motors by which they and the belt 27 are operated.

Figure 4:
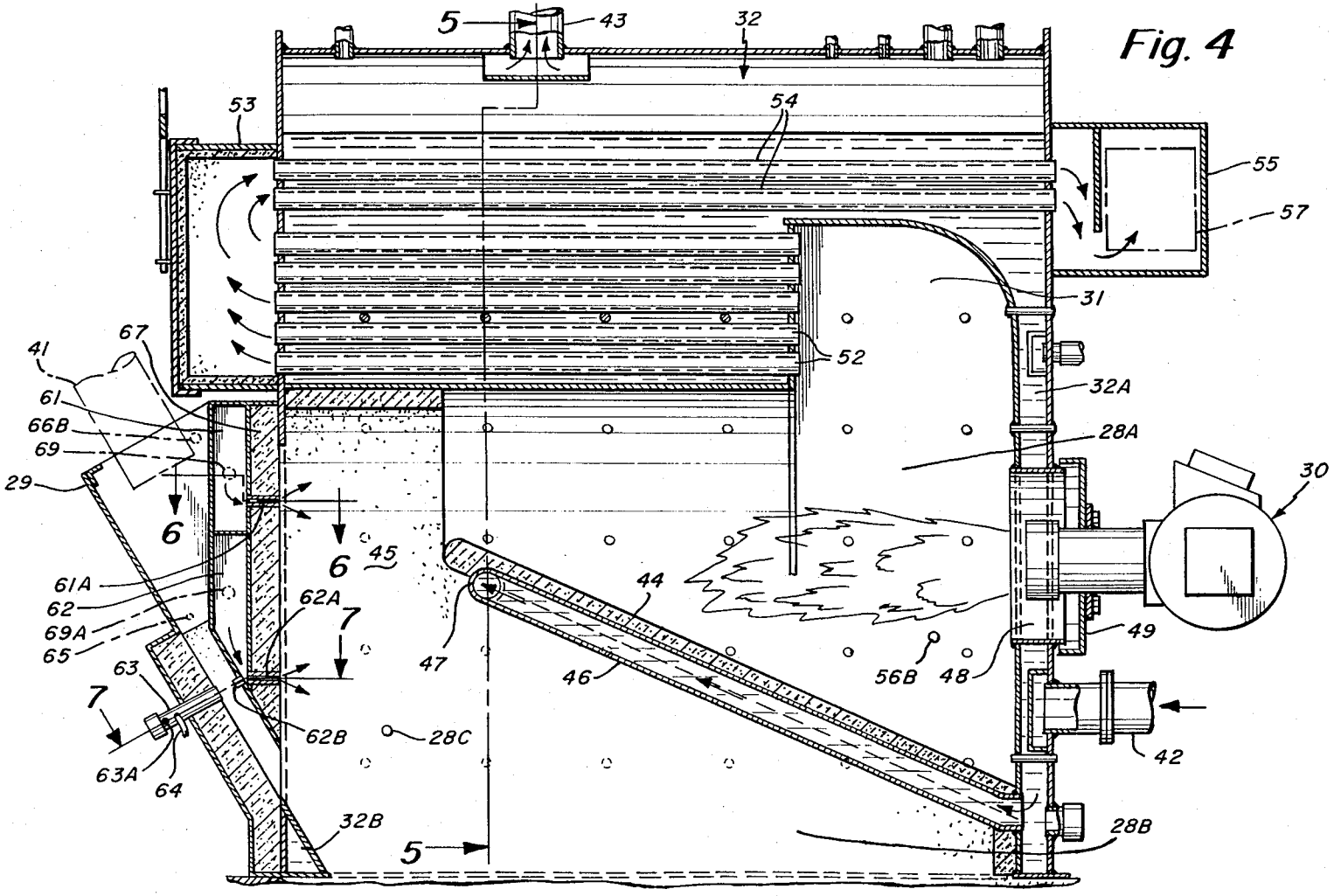
FIG. 4 is a section taken approximately along the indicated line 4—4 of FIG. 3.
Figure 5:
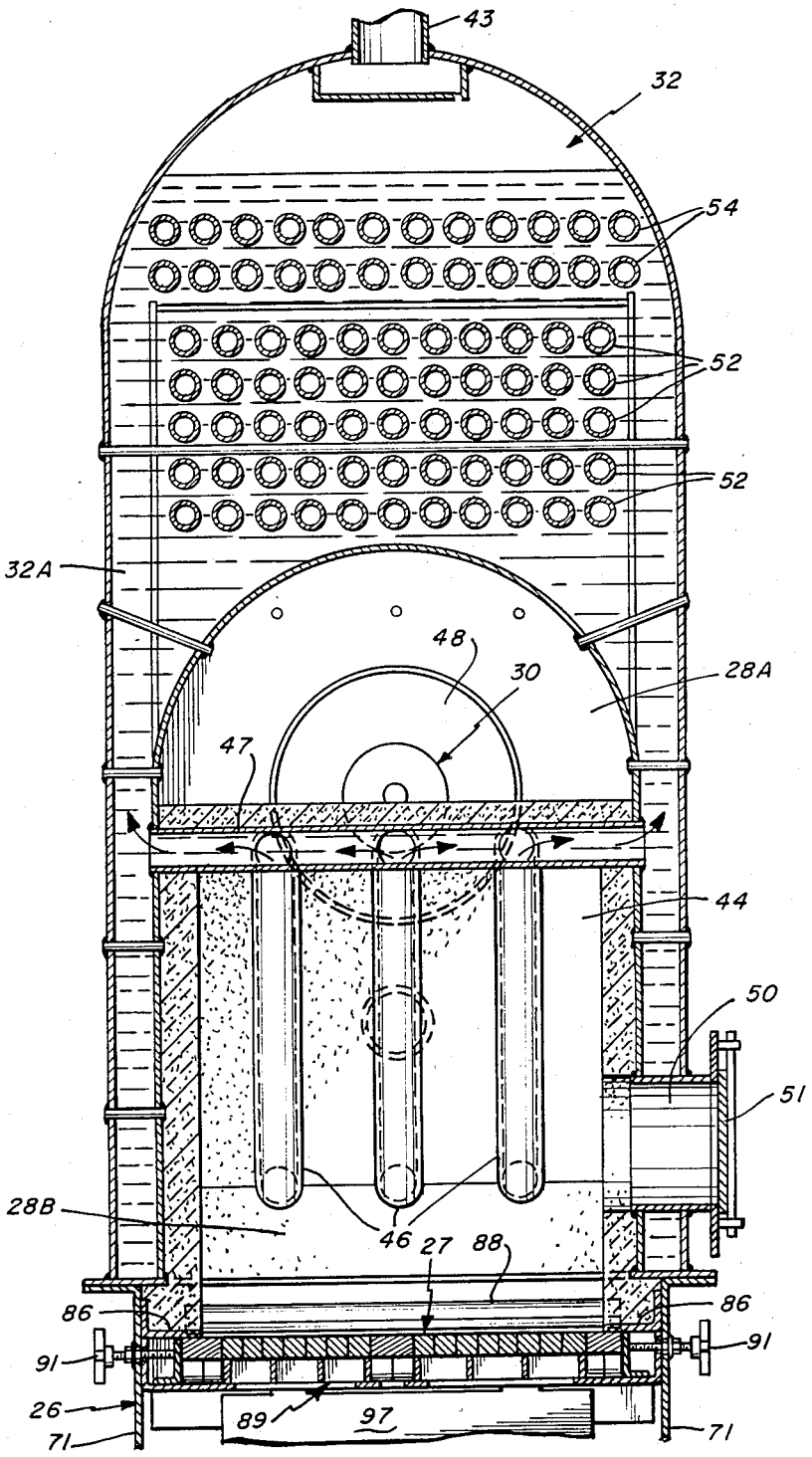
FIG. 5 is a section taken approximately along the indicated line 5—5 of FIG. 4.

Reference is now made to FIGS. 4 and 5 from which it will be seen that the heat exchange compartment 32 has a water jacket 32A extending along the sides and rear end of the combustion chamber 28 and a front leg 32B which extends across the front end of the combustion chamber below the discharge of the chute 29. The jacket has an inlet 42 adjacent the bottom thereof at the rear end of the boiler. The boiler 25 has a steam or water outlet 43 at the top of the compartment 32 which is also shown as provided with ports for the attachment of safety valves and a pressure gauge.

The combustion chamber 28, see FIGS. 4 and 5, is divided by a transverse partition 44 which is inclined forwardly and upwardly towards but terminates short of the front end thereof to provide a restricted flame and hot gas port 45 and to divide the combustion chamber 28 into upper and lower portions 28A and and 28B, respectively, with the standby burner 30 in the upper portion and the feed chute 29 opening into the lower portion which is provided with a heat sensor 28C. The partition 44 is of refractory material and includes supporting conduits 46 the lower ends of which open into the water jacket 32A at the rear end of the boiler and upper ends of which are connected to a transverse header 47 both ends of which are in communication with the interior of the jacket 32A.

Figure 2:
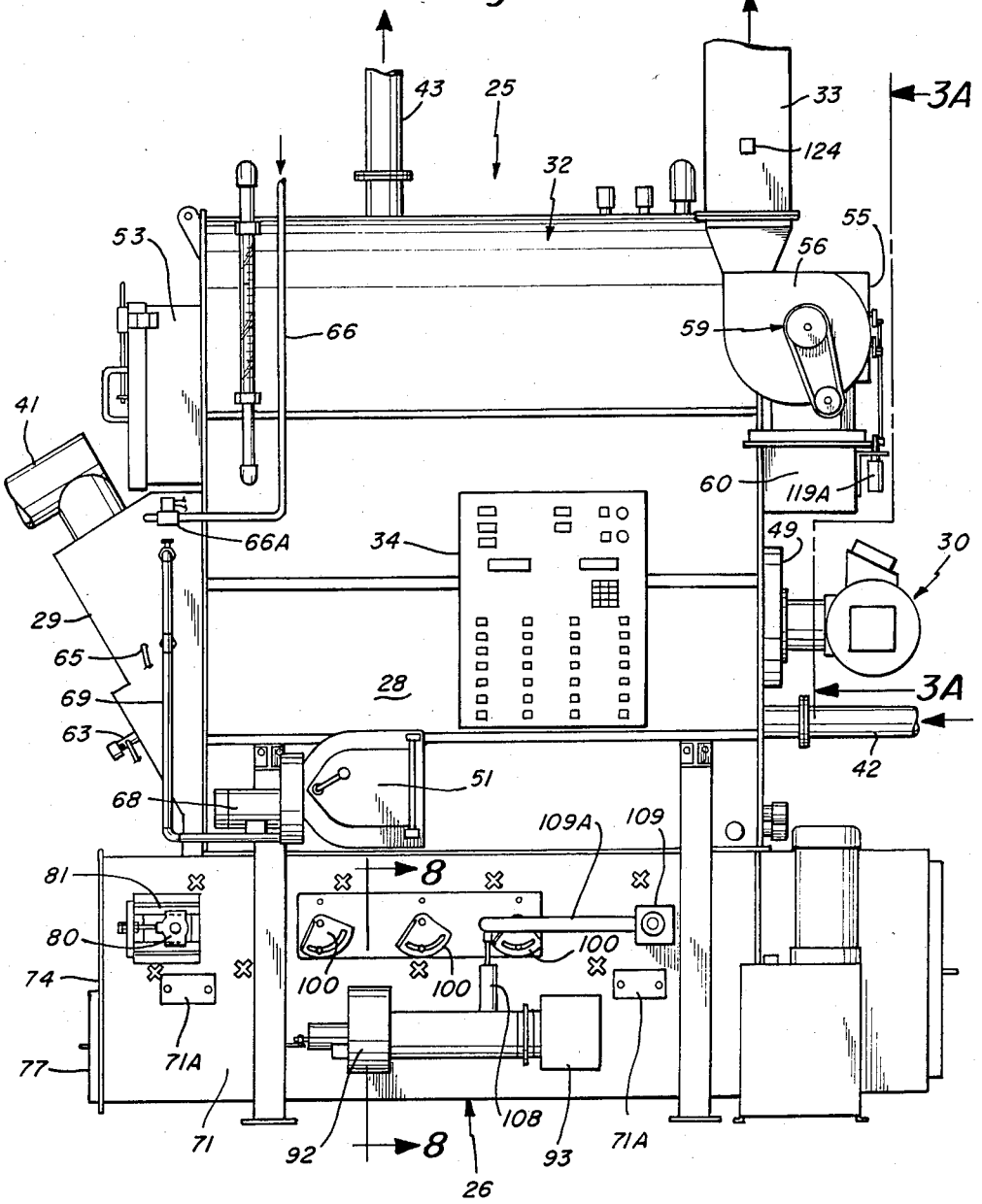
FIG. 2 is a side view of the stoker boiler.
Figure 3:
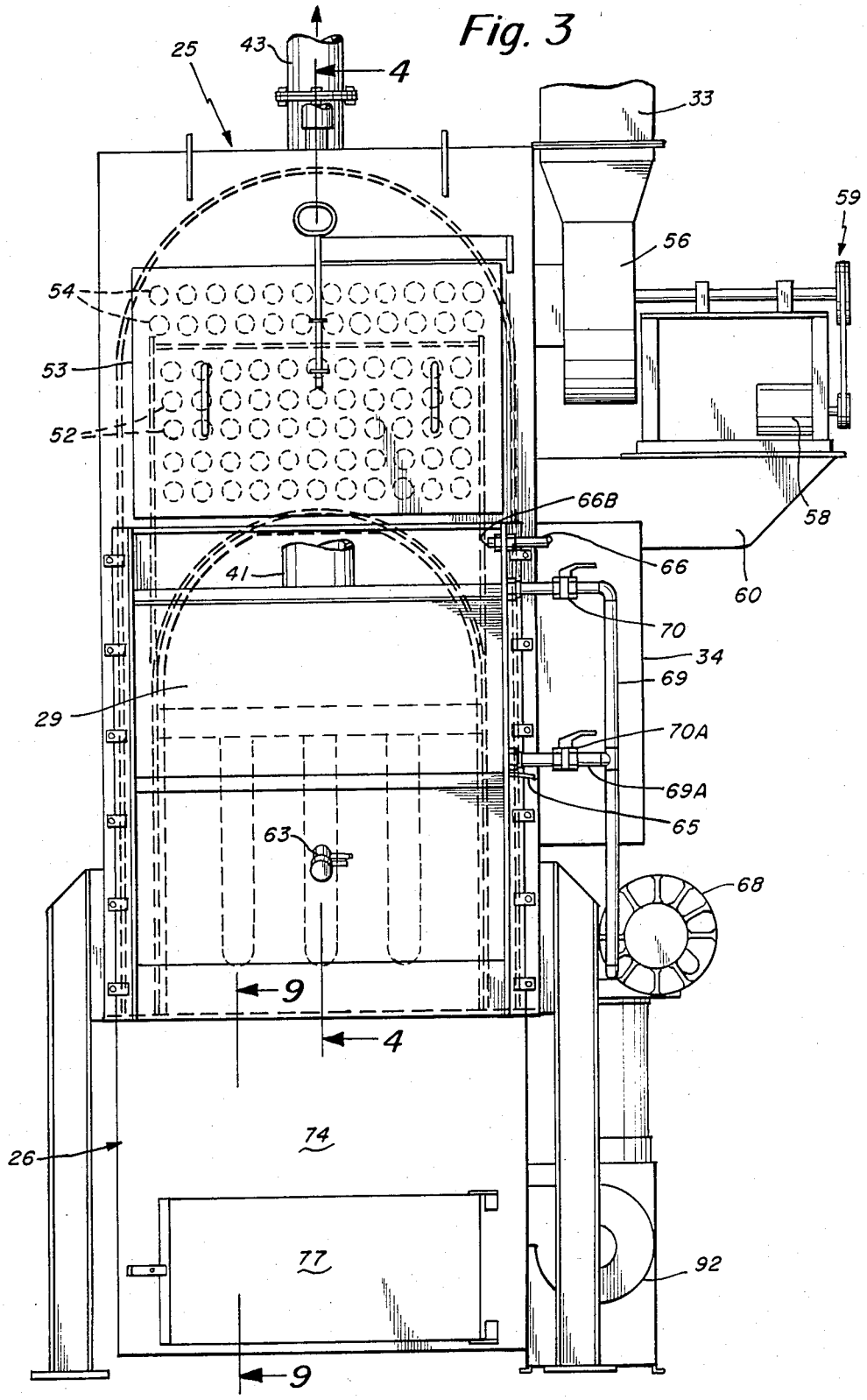
FIG. 3 is a front view thereof.
Figure 3A:
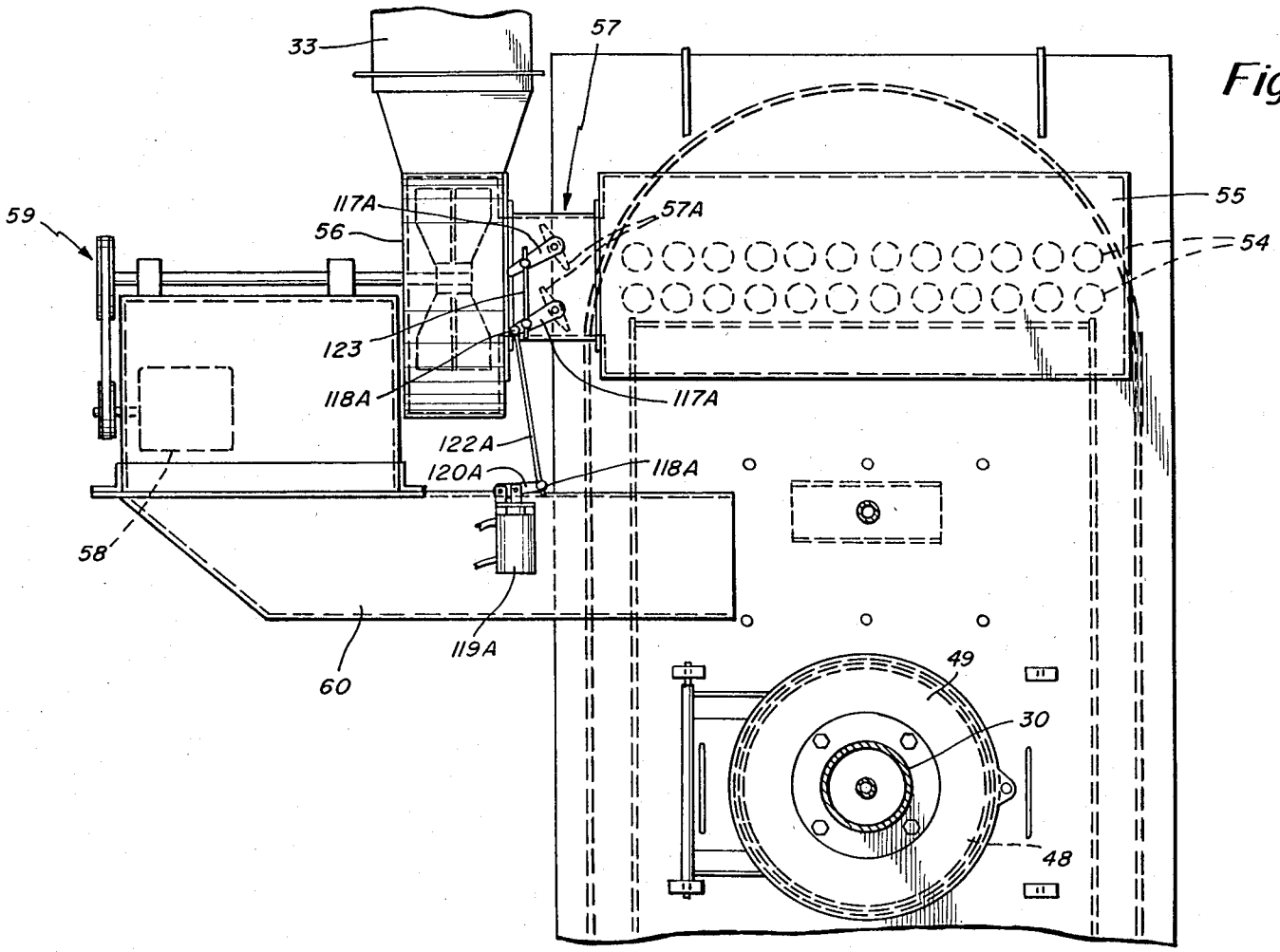
FIG. 3A is a section, on an increase in scale, taken approximately along the indicated line 3A—3A of FIG. 2.

The burner 30 is herein discussed as an oil burner, see FIGS. 3A and 4, the nozzle of which opens into the upper portion of the combustion chamber 28 through a circular access port 48 and provided with a door 49 by which the burner is supported. The lower portion 28B has an access port 50, see FIG. 2, adjacent the front end thereof and closed by the door 51.

The heat exchange compartment has, see FIG. 4, a series of hot gas tubes 52 supported by the front wall of the throat 31 and the front wall of the compartment 32. The tubes 52 open into a refractory lined clean-out box 53. A series of hot gas tubes 54 supported by the front and back walls of the compartment 32 effect communication between the clean-out box 53 and a baffled clean-out box 55 mounted on the rear wall of the boiler.

The intake side of a draft inducing fan 56, see FIGS. 2, 3, and 3A, opens into the box 55 through an adjustable damper 57 and its discharge is connected to the stack 33. The fan motor 58 and the fan drive, generally indicated at 59, are mounted on a bracket 60 and are best seen in FIG. 2. The induced draft is subject to control by adjustments of the damper 57 in a manner later described.

Figure 6:
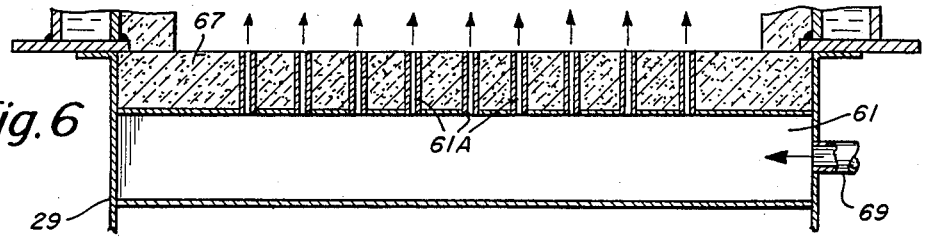
FIG. 6 is a section taken approximately along the indicated line 6—6 of FIG. 4.
Figure 7:
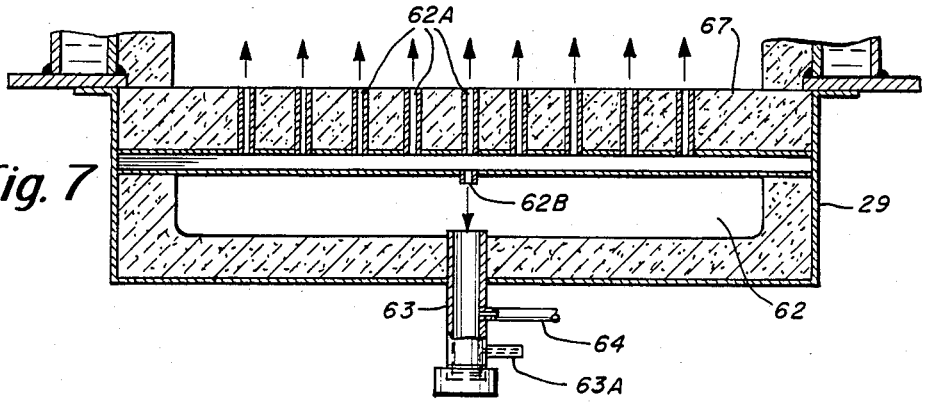
FIG. 7 is a section taken approximately along the indicated line 7—7 of FIG. 4.

Within the solid fuel feed chuts 29, see FIGS. 4, 6, and 7, there are plenums 61 and 62 for overfire air and provided with a transverse series of jet ports 61A and 62A, respectively, those of the plenum 62 discharging into the lower portion 28B of the combustion chamber below the port 45 and disposed to create turbulence therein and the jets 61A disposed to provide adequate combustion air in the upper portion 28A.

The plenum 62 also has a jet port 62B opening into the chute 29 which has a control conduit 63 axially aligned therewith and provided with a vent 63A. A conduit 64 of a smaller diameter is provided with a normally open, pressure operated switch, not shown, located within the computerized microprocessor 34. Unless fuel builds up in the chute 29 to block the flow of air from the port 62B to the control tube 63, air flowing therethrough and through the conduit 64 maintains the pressure switch closed as a consequence of which outputs are provided to effect the incremental delivery of fuel into the combustion chamber in small quantities with little or no build up of fuel in the chute 29.

The chute 29 is provided with a heat sensor 65 providing continuous inputs as to the temperature therein to the computerized microprocessor 34. If the chute temperature reaches a predetermined maximum, an output closes a circuit including the solenoid of a normally closed valve 66A in a water conduit 66 having a spray nozzle 66B opening into the chute 29. The chute 29 and the plenums 61 and 62 are parts of a removable, refractory lined panel 67 through which the jet ports 61A and 62A extend.

Overfire air, see FIGS. 2 and 3, from a suitable source such as the compressor 68, for example, is delivered to the plenum 61 via the pipe 69 which is provided with a volume-adjusting valve 70 and to the plenum 62 via the branch pipe 69A which is also provided with a volume-adjusting valve 70A. In practice, the valves 70 and 70A are manually operated as once appropriate overfire air volumes have been established for a particular type of fuel, further adjustments are usually not necessary.

The endless belt 27 and the base 26 in which it is mounted are detailed in FIGS. 5 and 8–14.

The base 26 has side walls 71 interconnected by transverse members 72 and secured to a base plate 73 as are front and back plates 74 and 75 with the former having an access port 76 closed by a door 77. Drive and idler shafts 78 and 79, respectively, are held by bearing holders 80 with the bearing holders for the drive shaft secured to the side walls 71 and those for the idler shaft 70 adjustably held by frames 81 secured thereto. Fast on each shaft are three transversely spaced sprockets 82.

The endless belt 27 consists of drive links 83 and plain links 84 both of which have sides tapering downwardly and inwardly from their flat, load bearing surfaces and central, similarly tapering projections 83A and 84A at corresponding ones of their sides. The projections 83A and 84A have shallow channels 83B and 84B, respectively, in their ends extending normal to their load bearing surfaces which in the assembled belt provide air passageways. The links are all of the same length and the extent of the projections is slightly more than their maximum widths. The links of both types have bores 83C and 84C adjacent their ends. The links differ in that the drive links 82 are substantially twice the width of the plain links and have a depending tapering tooth 83D at each of their ends for meshing engagement with the sprockets 82 and each of the drive links has bosses 83E through which the bores 83C extend.

Figure 12:
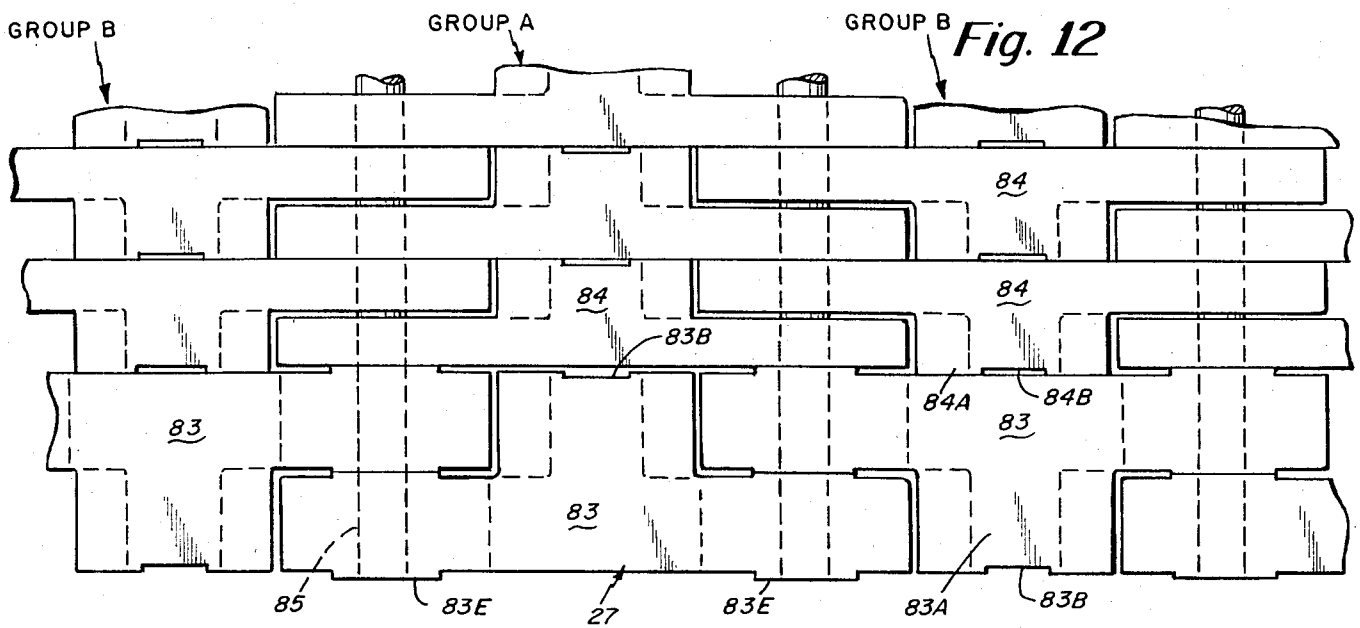
FIG. 12 is a fragmentary plan view, on an increase in scale of the belt.
Figure 13:
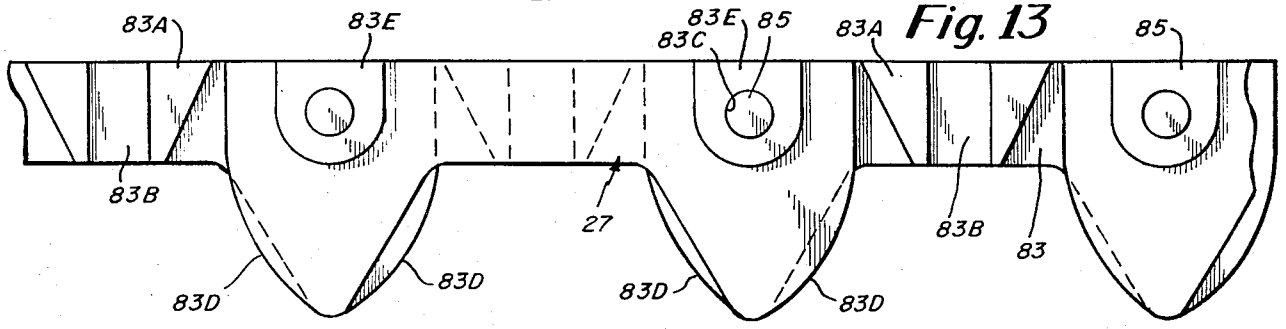
FIG. 13 is a side view of that part of the belt shown in FIG. 12.
Figure 14:
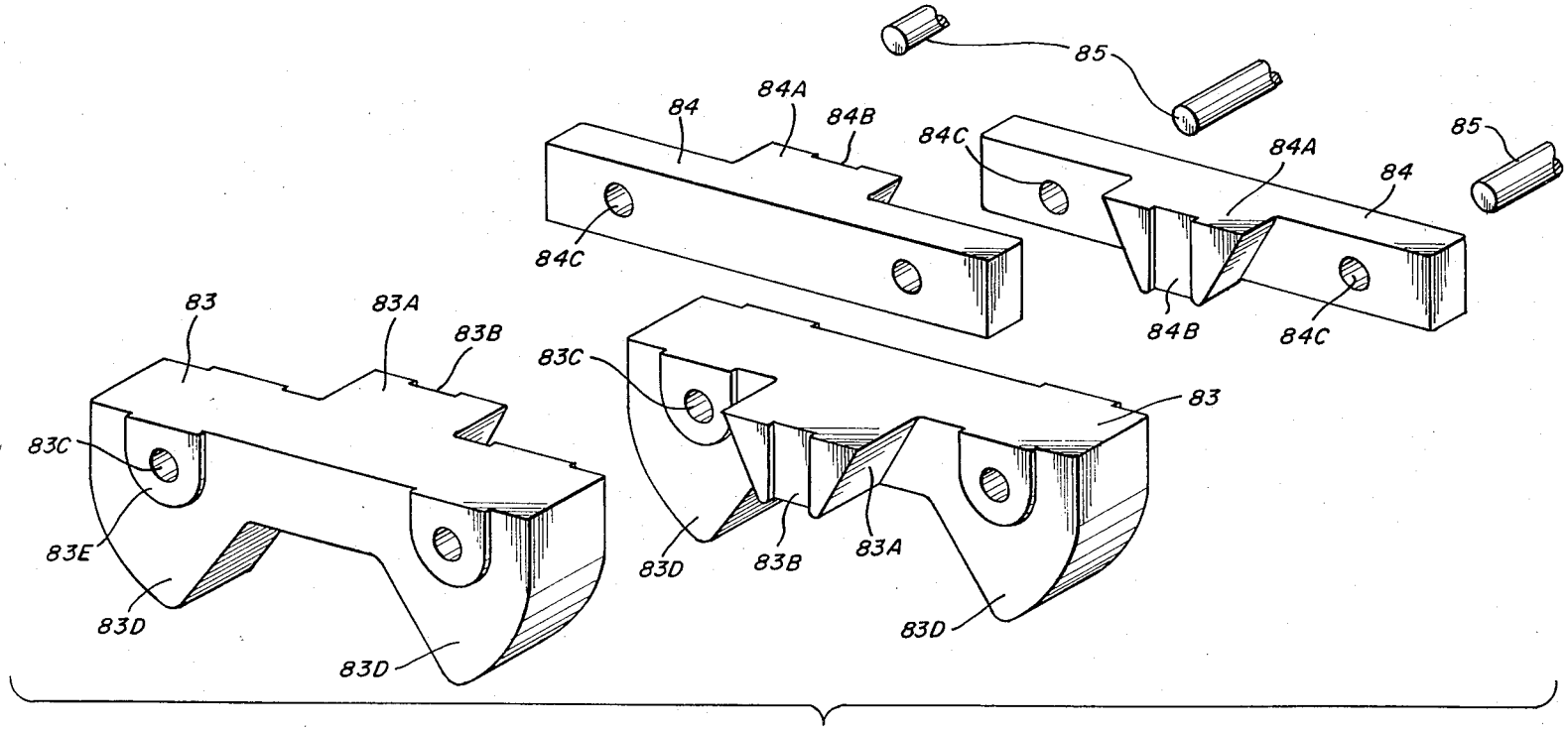
FIG. 14 is a perspective, exploded view of drive and plain links of the belt.

In practice and as shown, the links are arranged in groups A and B, see FIGS. 12 and 13, which alternate to form the necessary length of the belt 27. In Group A, there are two side drive links 83 between each of which and an intermediate drive link 83 there is a series of plain links 84 with their projections 83B and 84B disposed in the same direction thus establishing gaps which are slightly greater than the width of the links. The Group B differs only in that the projections 83B and 84B are all disposed oppositely to those of the links in each series A whereby the ends of adjacent series are freely interfitted in adjacent gaps. The series of groups A and group B links are joined by pivot rods 85 extending through the bores 83C and 84C. The bosses 83E and channels 82E and 84B establish additional air gaps in the assembled belt 22 to ensure proper uniform distribution of the underfire air. In practice, the width of the air gaps is in the approximate range of one thirty-second to one-sixteenth of an inch.

Each side wall 71 of the base 26 has a support 86 for refractory bricks. The support 86 has end portions 86A and 86B. The ends 86A are shaped to support a top plate 87 which overlies the infeed end of the belt 27 and the sprockets 82 on the idler shaft 79 and the ends 86B are curved to support the arcuate ash plate 88 which overlies the other end of the belt and the sprockets 82 on the drive shaft 78 and serves to hold back burning fuel.

An air control assembly 89 in support of the upper course of the belt is attached to the side walls 71 of the base and supports side guide assemblies 90 which surround the path of the belt 27. The assembly has a central, lengthwise channel 89A for the teeth of the central drive links 83 at the sides of the belt 27. The side guide assemblies support the side drive links and are made in sections interconnected by members 90A which, when removed, permit access to the links of the lower course of the belt 27. The side walls 71 have removable covers 71A which, when removed, expose the members 90A. The side guide assemblies 90 prevent lateral movement of the pivot rods 85 and are positioned as by means of adjusting screws 91 threaded through the vertical walls 71 and against the walls of the guide assemblies 90.

A blower 92 drawing air through a filter 93 discharges underfire air through an adjustable damper 94 into the base 26 through a port 95 below the lower course of the belt 27. Control of the volume of underfire air is established by the appropriate adjustment of the damper 94 in a manner later to be described. While the underfire air passes through the narrow gaps in the belt, the underfire air volume is distributed lengthwise of the upper course of the belt 27 by a series of damper controlled plenums opening through the air control assembly 89.

In the disclosed embodiment of the invention, there are three plenums, the plenums 96, 96A and 96B extending lengthwise of the upper course of the belt between the top plate 87 and the ash plate 88 and divided by the central channel 89B which desirably has ports spaced lengthwise thereof. The plenums 98, 98A and 98B are separated by transverse partitions 89B of the air control assembly 89 and each is divided by the lengthwise partitions 89C thereof. The ends 89E of the assembly 89 and the partitions 89B and 89D thereof serve to support the upper course of the belt 27. It will be noted that the supports 86 overlie the margins of the belt 27. Each plenum 96, 96A, and 96B has a damper 97 hingedly connected thereto as at 97A and its undersurface has a channel 97B in which one end of an arm 98 is slidably confined. Each arm 98 is fast on the appropriate one of the rods extending through the sides 71 of the base. The ends of each rod 99 is provided with an adjusting quadrant 100 enabling the position of each damper to be determined.

In order to establish and maintain proper combustion, it is necessary to make appropriate adjustments and readjustments of the damper 94 in control of underfire air volumes and of the damper 57 in control of the induced draft and the rate at which fuel is fed to and through the lower portion of the combustion chamber 28. While such adjustments can be made manually or by a manually operated control, control of such adjustments is best effected by the computerized microprocessor 34.

Figure 15:
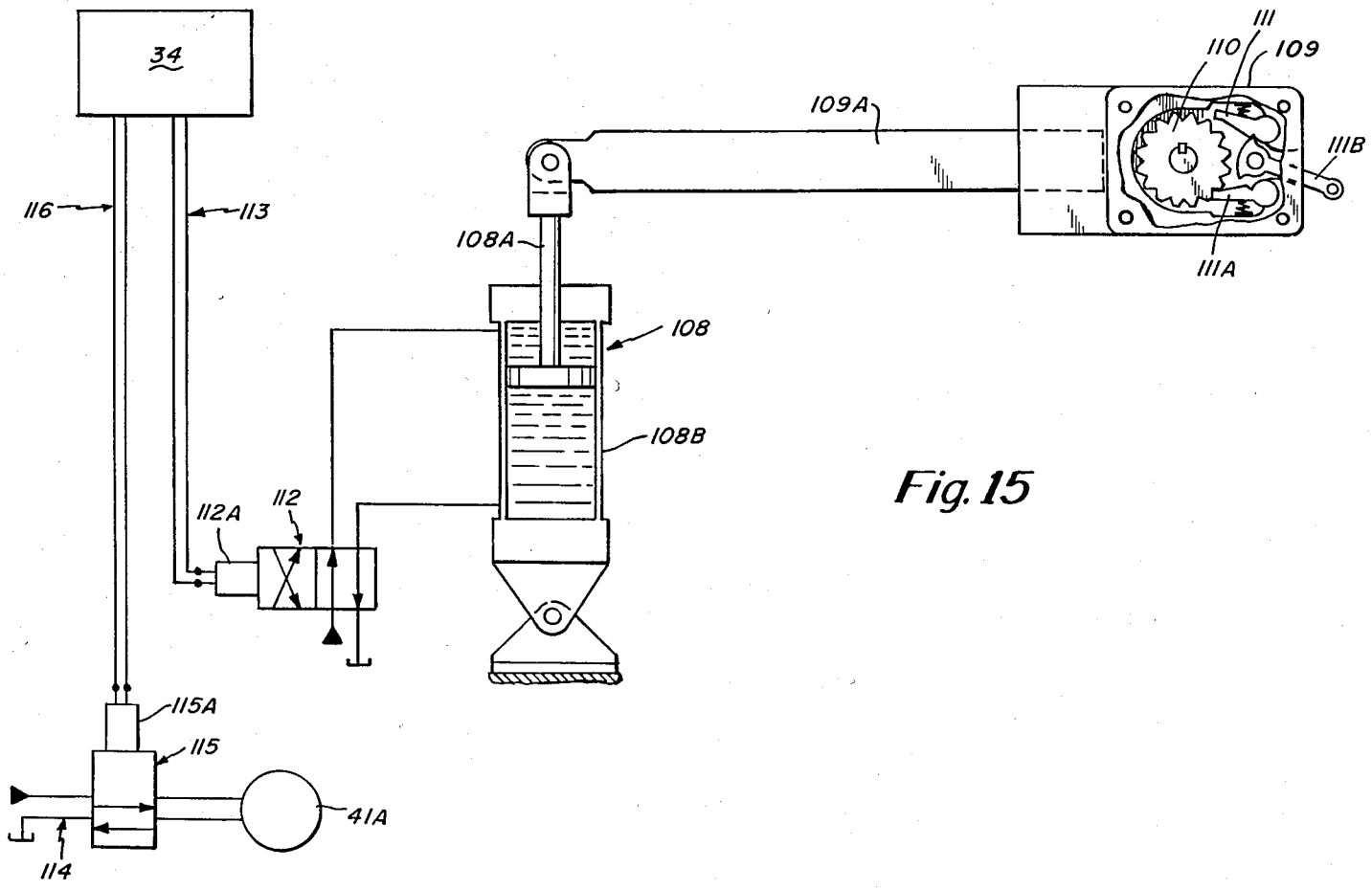
FIG. 15 is a schematic view of the controls effecting changes in belt travel rates by increments and the delivery of fuel to the belt in proportional increments.

Belt travel, see FIG. 15, is effected in increments of two inches by way of example and not of limitation. Such travel may be effected by a hydraulic motor such as the motor 41A and controlled in a like manner or, and as shown by a pawl and ratchet type of connection with the drive shaft and operated by a piston cylinder unit 108.

The unit 108 may be either pneumatically or hydraulically operated as herein discussed. The piston rod 108A is connected to one end of an arm 109A of a housing 109 in which there are spring backed pawls 111 and 111A either one of which is brought into operating engagement with the ratchet gear 110 fast on the drive shaft 78. Such engagement is effected by means of the pivoted pawl shifter 111B thus enabling the belt to be moved in either direction.

The delivery fluid under pressure from a suitable source to and from the cylinder 108B to effect piston travel in either direction is under the control of a solenoid operated valve 112. The piston rod may be reciprocated by closing the circuit 113 which includes the solenoid 112A of the valve 112 to effect movement of the piston rod 108A the full distance in one direction with the valve 112 returning to effect movement of the piston rod the full distance in the other direction once the circuit 113 is opened. The computerized microprocessor is programmed to ensure such reciprocation.

The hydraulic motor 41A by which the screw conveyor 41 is operated is in a hydraulic line 114 having a normally closed, solenoid operated valve 115 with its solenoid 115A in a circuit 116. Whenever and while the circuit 116 is closed, the motor 41A is operated to effect the delivery of fuel into the chute 29. In practice, the circuit 116 is closed by an output of the computerized microprocessor 34 in response to the input received via the control conduit 63 and the conduit 64. The microprocessor 34 is so programmed that the circuit remains closed for short intervals, in practice less than ten seconds and depending on the particular fuel being burned.

Figure 8:
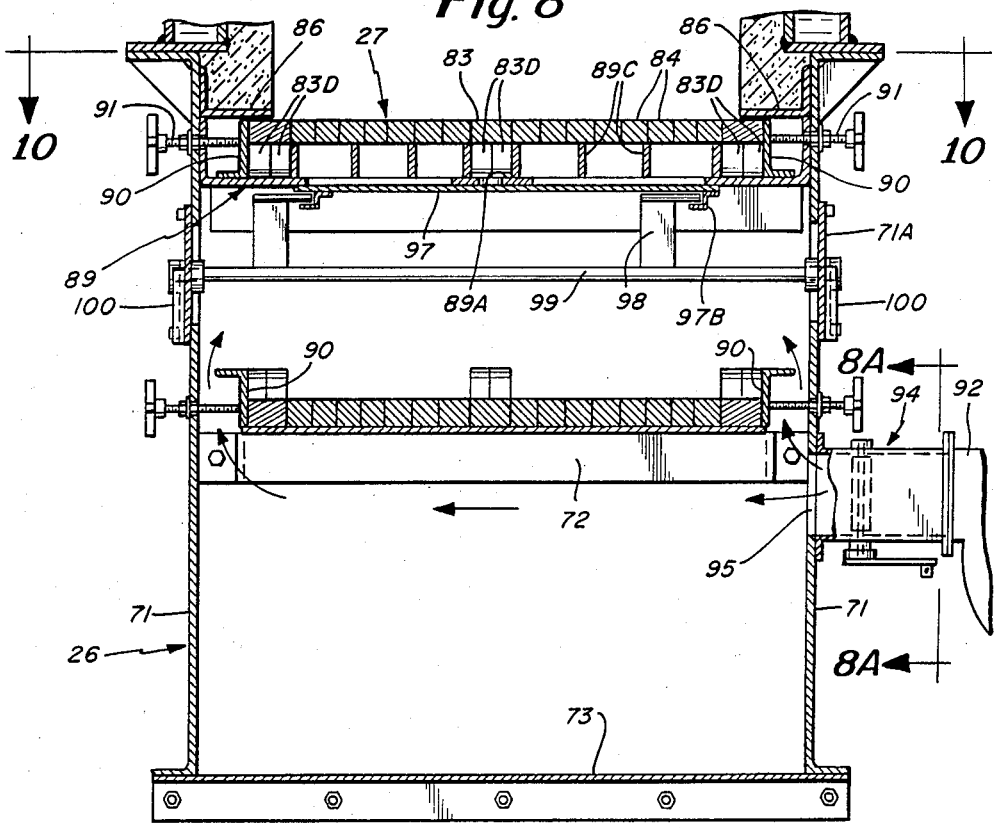
FIG. 8 is a section taken approximately along the line 8—8 of FIG. 2.
Figure 8A:
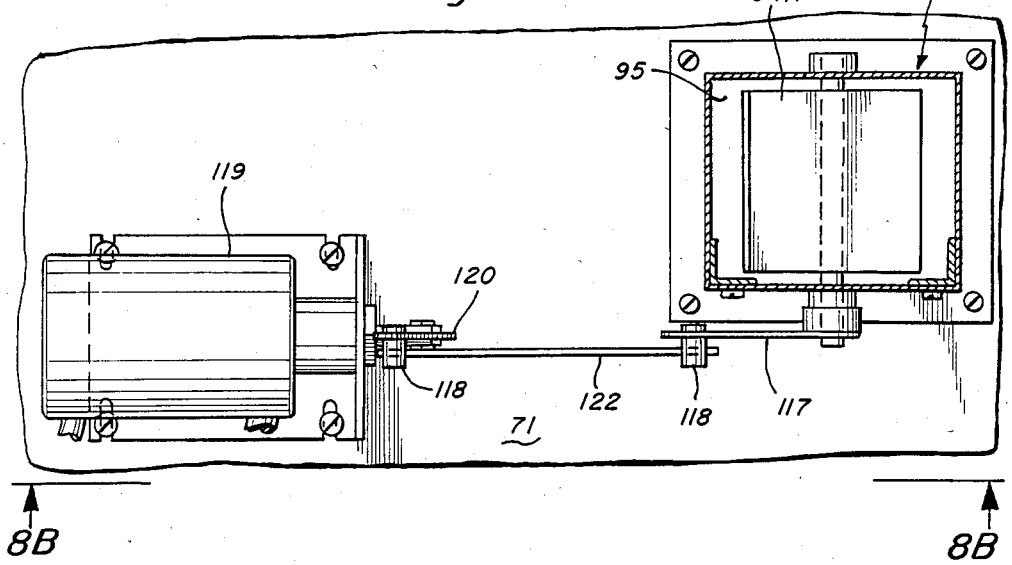
FIG. 8A is a section, on an increase in scale, taken approximately along the indicated line 8A—8A of FIG. 8.
Figure 8B:
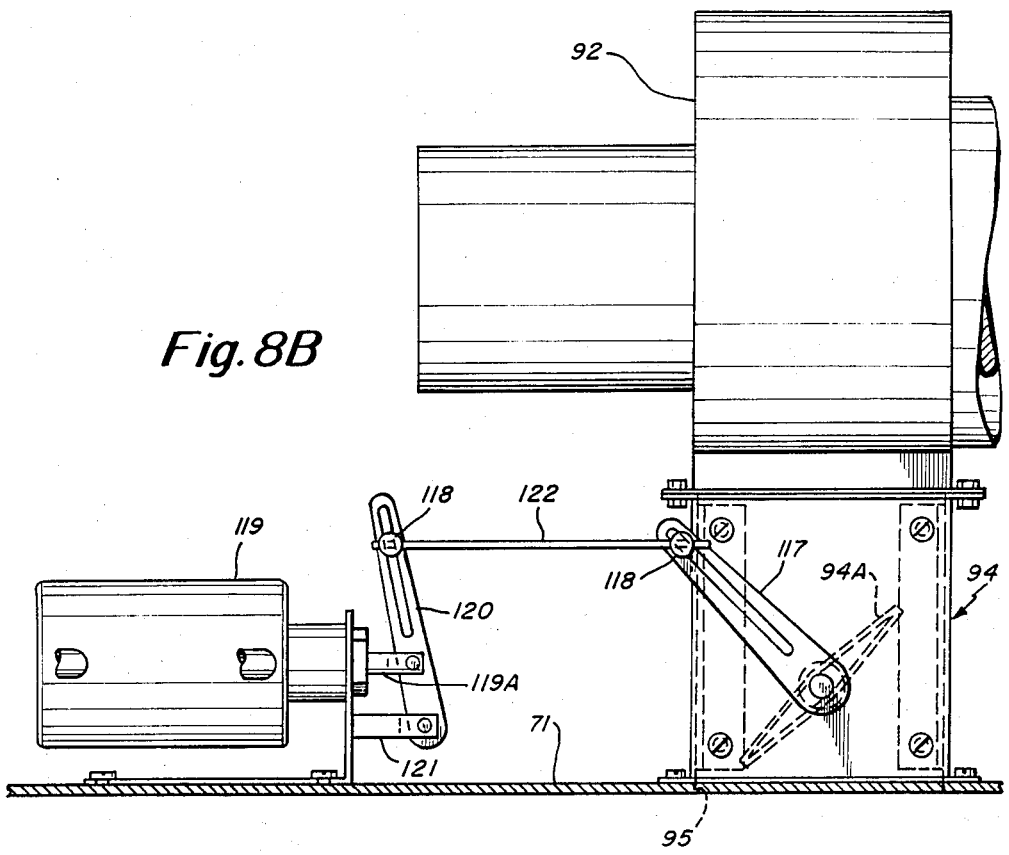
FIG. 8B is a view taken along the indicated line 8B—8B of FIG. 8A.
Figure 9:
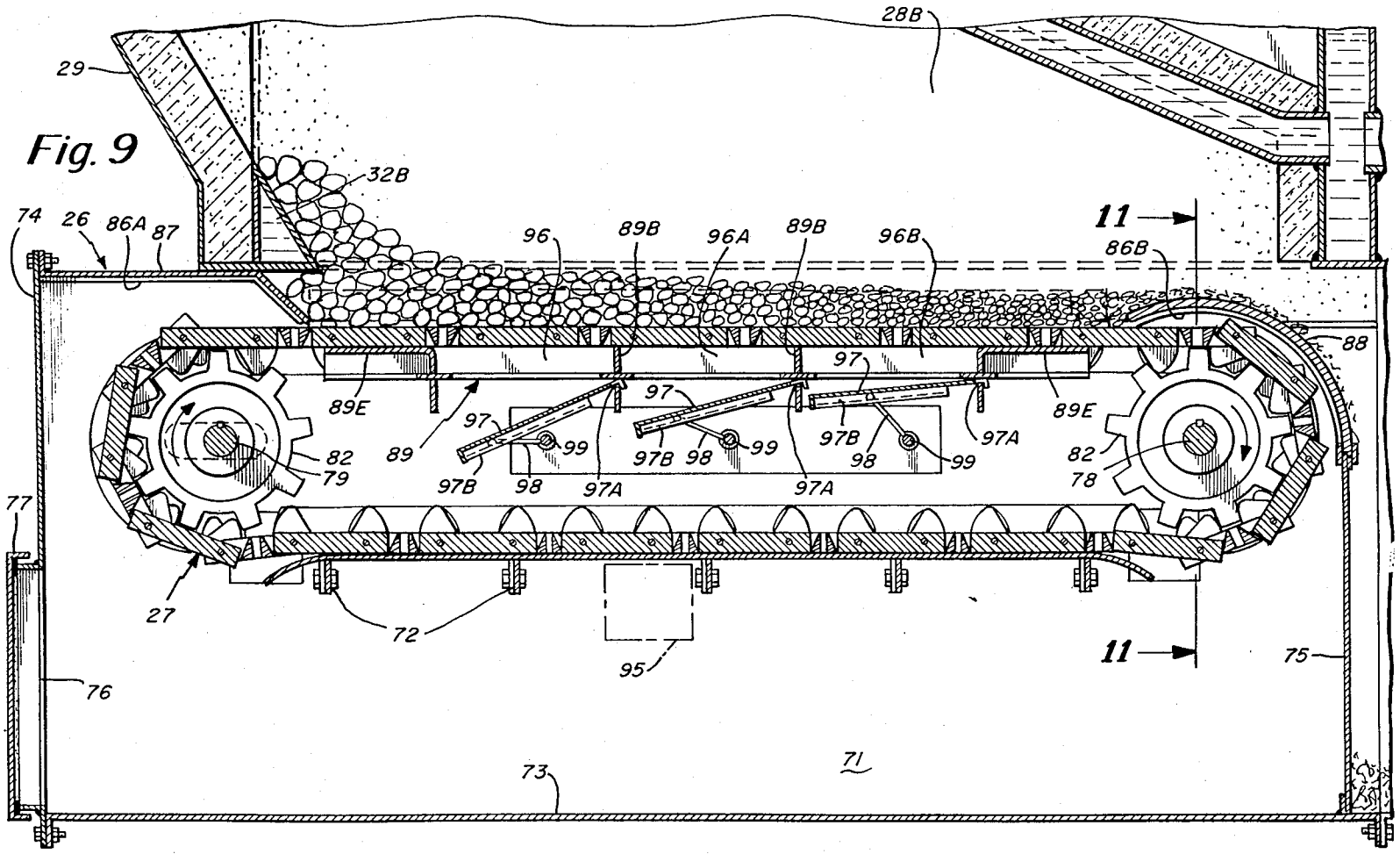
FIG. 9 is a section taken generally along the indicated line 9—9 of FIG. 3.
Figure 10:
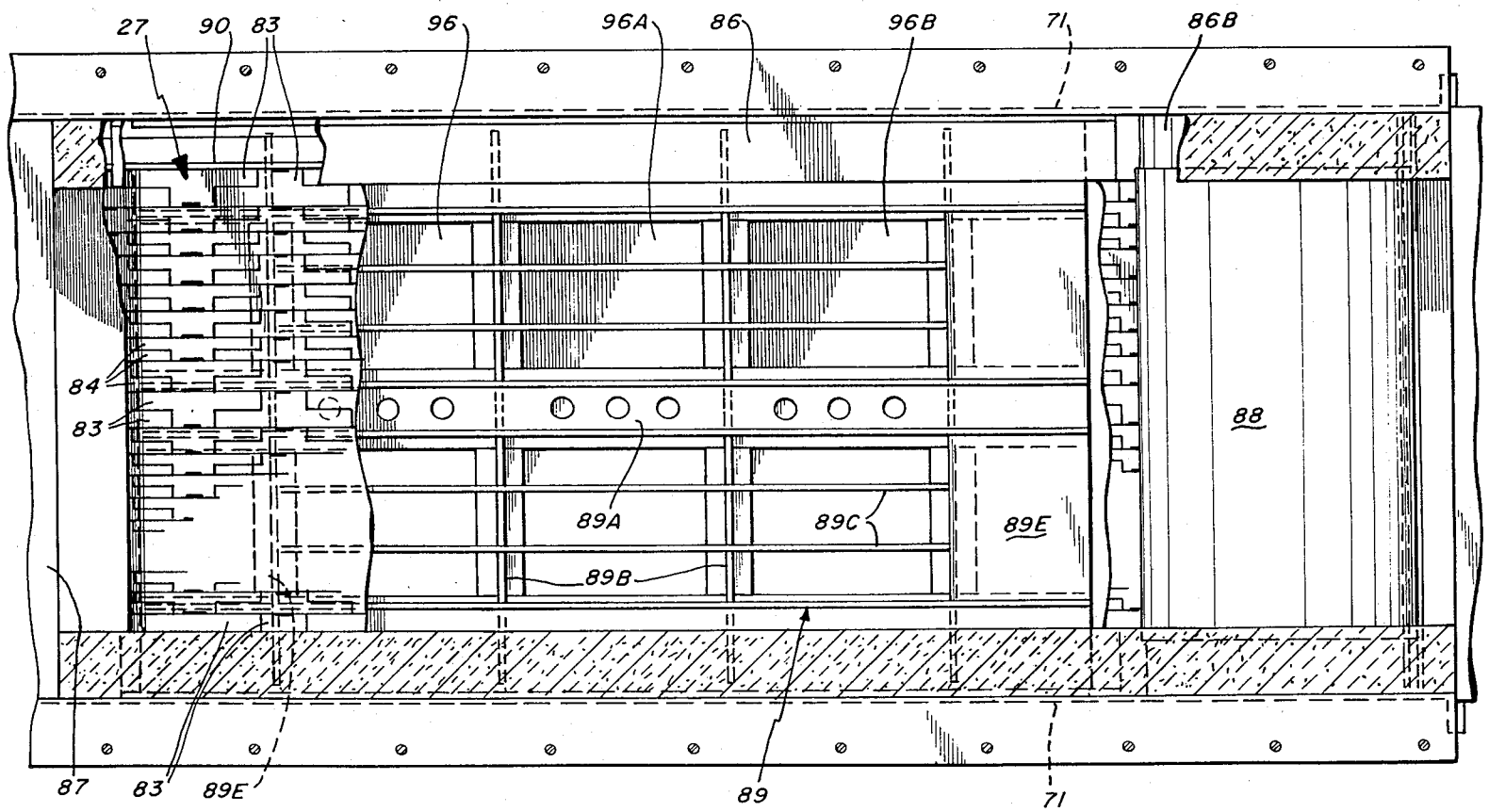
FIG. 10 is a section taken approximately along the indicated line 10—10 of FIG. 8.
Figure 11:
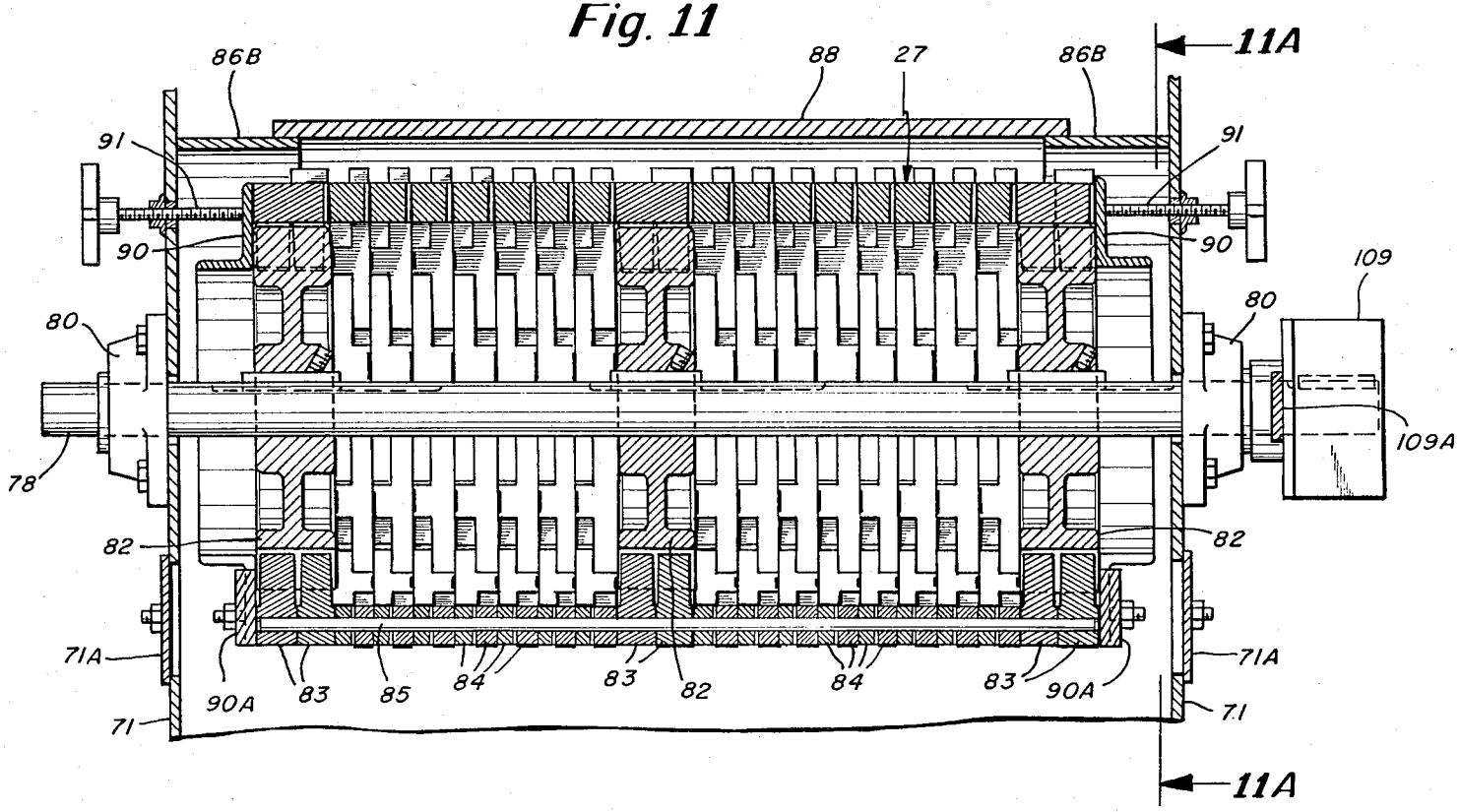
FIG. 11 is a section taken generally along the indicated line 11—11 of FIG. 9.
Figures 11A, 11B, 11C:
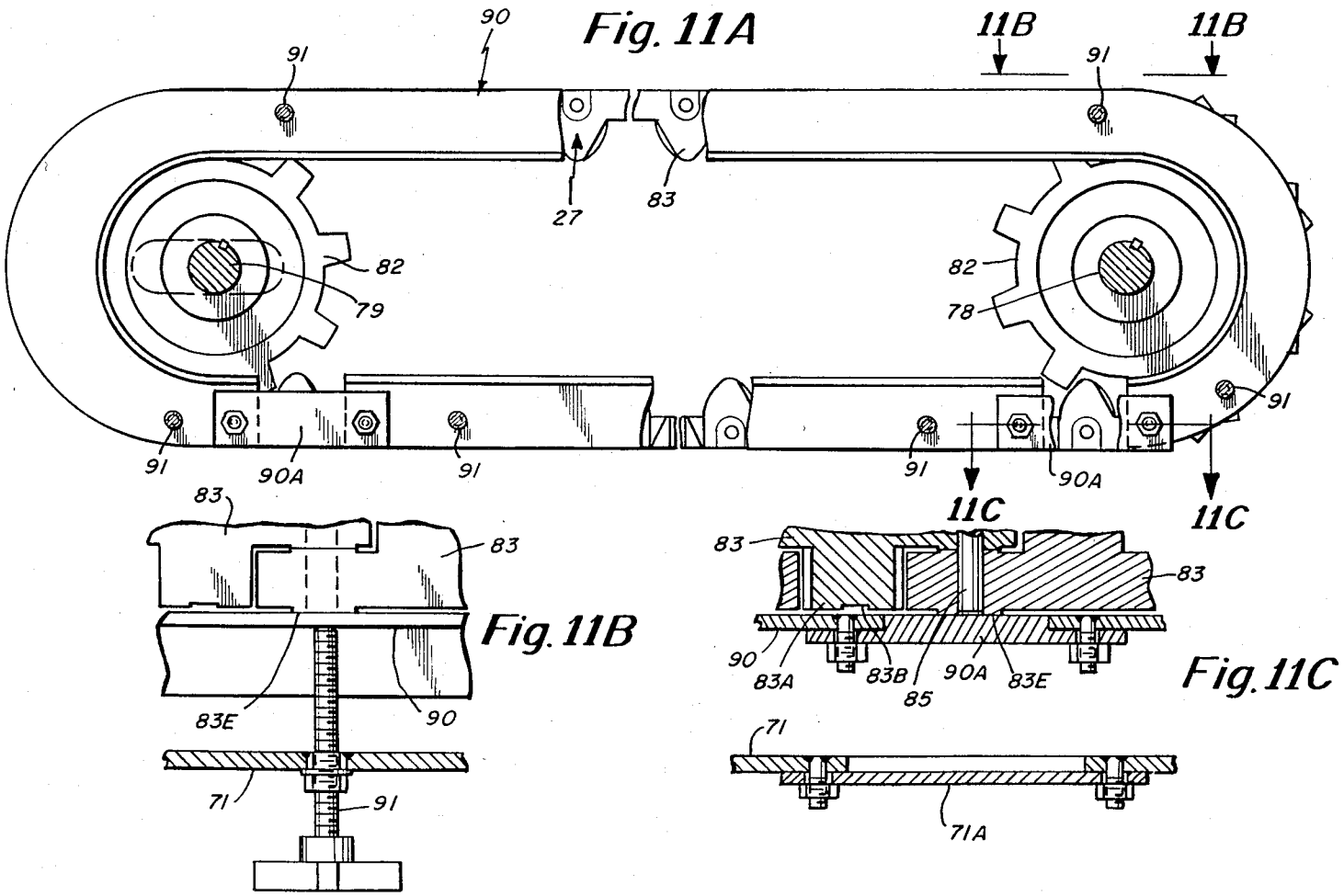
FIG. 11A is a section, on an increase in scale taken along the indicated line 11A—11A of FIG. 11 to show the side guide assembly.
FIG. 11B is a section, on a further increase in scale, showing the portion of the assembly underlying the line 11B—11B of FIG. 11A.
FIG. 11C is a section taken approximately along the indicated line 11C—11C of FIG. 11A.

In FIGS. 8A and 8B, the blade 94A of the damper 94 in control of underfire air volumes has one end of an arm 117 fixed on its pivot. The other end of the arm 117 has a lengthwise slot in which a pivot 118 is fixed in a predetermined position. Adjustments of the damper are effected by an actuator in the form of a piston-cylinder unit 119 having its piston rod 119A pivotally connected to an arm 120 one end of which is pivotally connected to an anchor 121. The other end of the arm 120 has a lengthwise slot in which a pivot 118 is fixed in a predetermined position. A rod 122 interconnects the two pivots 118 whereby fluid under pressure delivered to either end of the cylinder of the unit 119 results in the turning of the damper in the appropriate direction either to increase or decrease the underfire air volume.

In FIG. 3A, the damper 57 in control of the induced draft has two blades 57A and is adjusted in the same manner as that employed to adjust the damper 94 and, accordingly, like reference numerals are employed to designate corresponding parts which are distinguished by the suffix addition "A". The two blade adjusting arms are interconnected by a link 123 so that they swing together.

Figure 16:
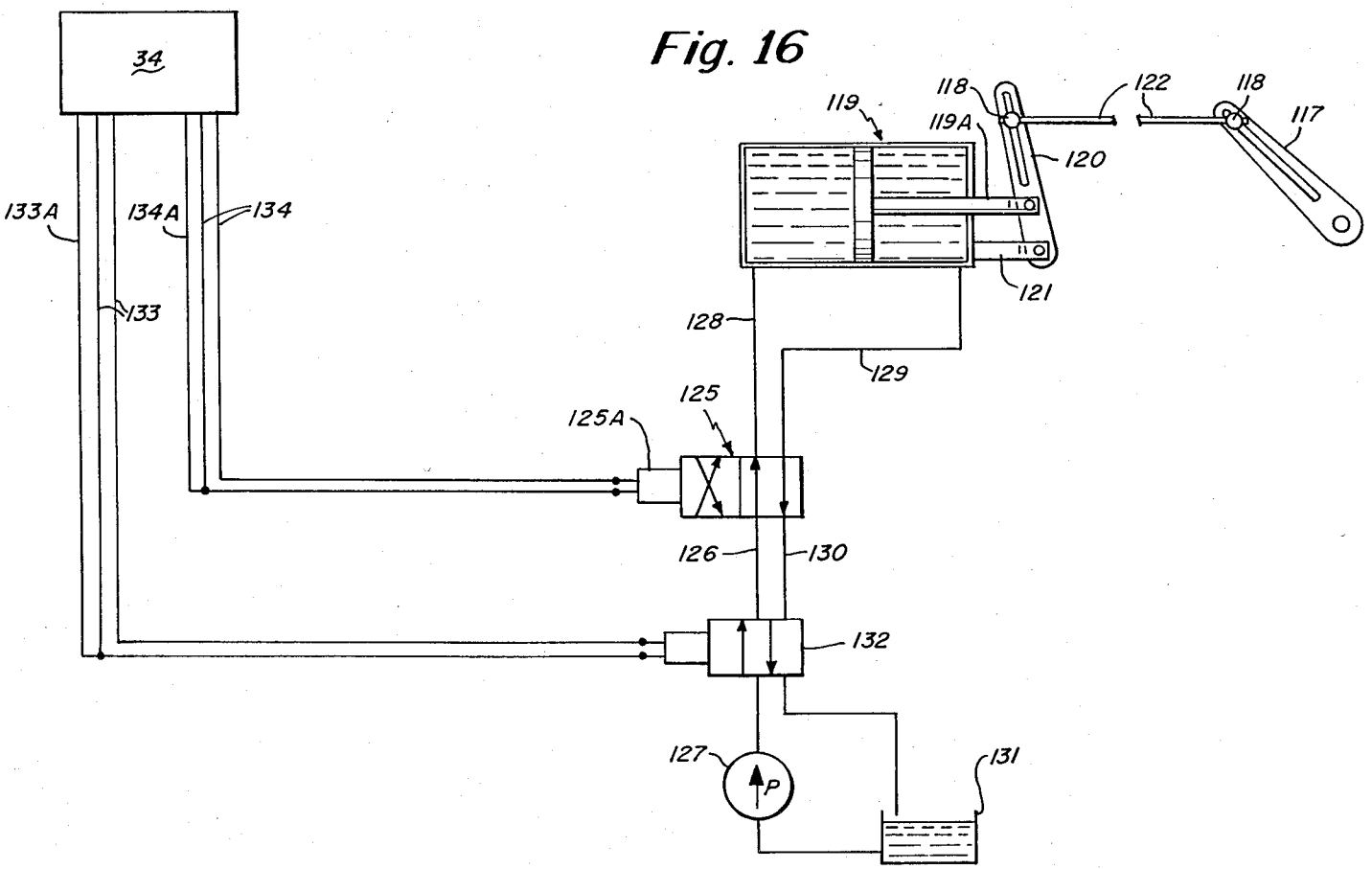
FIG. 16 is a like view illustrating the control effecting the incremental adjustment of the damper in control of underfire air volumes.

The incremental adjustments of both dampers 57 and 94 are made in the manner schematically illustrated by FIG. 16 and are detailed with reference to the damper 94. In the case of the damper 94 and if the exhaust 33 downstream of the draft inducing fan 56 is provided with a sensor 124 responding to the emission of oxygen, for one example, the sensor provides an input to the computerized microprocessor 34, responding outputs are employed to "fine tune" the underfire air volume by adjusting the damper 94 by increments smaller than those made along with adjustments of the damper 57.

The hydraulic circuit by which the piston-cylinder unit 119 is operated to pivot the adjusting arm 117 of the damper 94 has a solenoid operated valve 125. The valve 125 has a normal first position in which it connects the delivery line 126 from the pump 127 to the conduit 128 connected to the upper end of the cylinder of the unit 119 and the conduit 129 from the lower end of that cylinder to the return line 130 to the tank 131. The delivery line 126 and the return line 130 both have a normally closed, solenoid operated valve 132 in a circuit 133.

In the first or normal position of the valve 125 and if the valve 132 is opened, the piston rod 119A is moved in a retracting direction then to effect the opening of the damper. The solenoid 125A of the valve 125 is in a circuit 134 and if that circuit and the circuit 133 are both closed, the piston rod 125 is extended to effect the movement of the damper blade towards its closed position.

The computerized microprocessor is programmed to provide output to effect the closing of the circuit 133 for a predetermined interval in response to inputs that the volume of underfire air needs to be increased and the simultaneous closing of the circuits 133 and 134 when the underfire air volume is to be decreased. Such adjustments occur with adjustments of the induced draft which responds to the induced draft sensor 56B, see FIG. 4.

After such adjustments have been made and if there is an input to the computerized microprocessor 34 from its sensor 124 that the detection of oxygen indicates a continued need to reduce the underfire air volume, the program provides an output closing the circuit 133 via a lead 133A providing an interval of adjustment shorter than normal and an output closing that circuit 134 via the lead 134A thus to achieve the wanted "fine tuning" of the underfire air volume.

Figure 17:
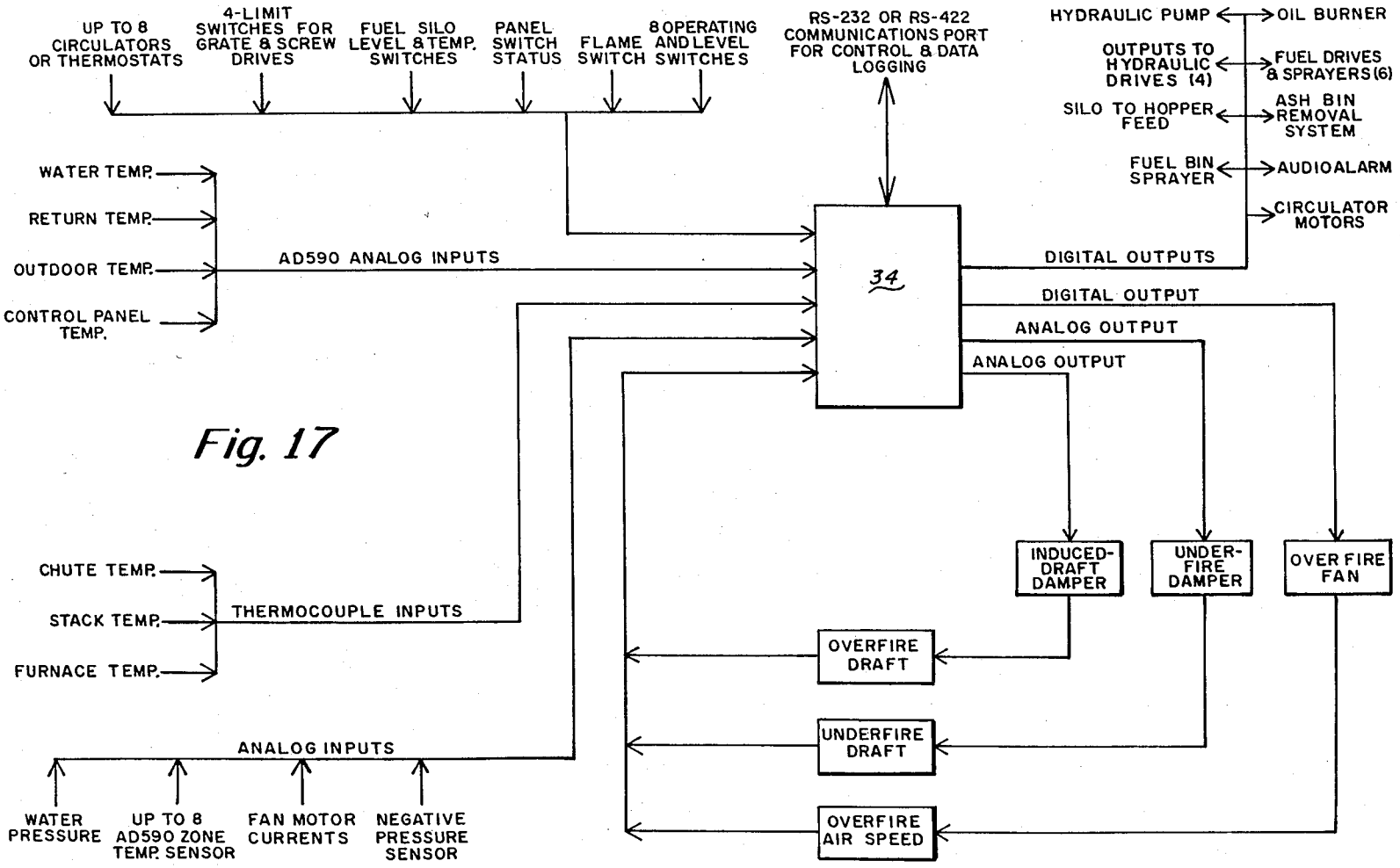
FIG. 17 is a schematic view illustrating the inputs to and outputs from the computerized microprocessor.

For the the operation of the boiler 25 in its preferred manner, its control may best be summarized by the following algorithm after first considering FIG. 17 in which the inputs to the computerized microprocessor 34 and their sources are shown together with the output therefrom and operations controlled thereby.

Control Algorithm

1. There are two general algorithms to follow; they being the computer EPROM format and the redundant oil burner circuitry.

2. The face panel of the computerized microprocessor 34 is comprised of a keyboard for entry to the computer, a safety push button control to overide both modes and disable boiler operation, an oil select and overide switch, and a series of LED's to indicate system, component or group operations and failures.

3. In the oil select mode, the computer is disabled from the system control and the only group of operating and safety controls that function are the safety high limit, operating high limit, high and low fire control, low water control and pressure relief. These controls are standard operating controls and control the on and off operation of the boiler and burner combination.

4. In the computer mode the entire boiler is controlled by the standard controls indicated in (3) and the sensors located at various points in the system which measure temperature, pressure, currents, voltages, fuel levels and other necessary discrete, digital and analog inputs to be defined herein.

A. Via the keyboard three memory values for solid fuel #1, #2 and #3 are assigned to the computer RAM for belt travel rate and fuel feed rate. These values represent the 100% rated boiler output value for the particular fuel, and may be recalled via a two digit code for future use. Values are displayed on a LED display (not shown) for easy reading. These initial values may be modifie1 at any point, but the main purpose is to define a particular fuel type; e.g., bituminous coal, 40% wet wood chips, or cocoa bean shells, by way of examples.

B. Again via a keyboard (not shown) the computer is accessed to start operation on solid fuel. The induced draft fan 56 begins operation and upon clarification via the induced draft transducer that a minimum draft has been established, the other motor groups begin operation as outlined below.

1. The underfire air system blower 92 starts.
2. Underfire air proportional damper 94 is at its full open position.
3. The induced draft proportional damper 57 is at its desired draft setting.
4. The overfire air fan motor 68 starts the pump of the hydraulic motor system.
5. The fuel feed screw 41 is operated at full fuel selected value.
6. Belt travel rate is established at the full travel rate.

C. At this point the fire is started manually and must be monitored for approximately one hour until the refractory temperature reaches a predetermined level. Manual adjustments to the fuel feed and belt travel may be accomplished at this time to insure that the fire continues satisfactorily. All other systems will operate normally while fuel and belt travel rates are in the overide mode.

D. Once the fire has established itself, the system is controlled by the standard safety and operating controls, and computer analog temperature and ratiometric sensors. System temperature and pressure are displayed on separate LED display windows. The boiler will continue to operate in the selected high mode with the following conditions.

1. Full underfire air volume is established for the selected fuel value.
2. The proper overfire draft is measured by the overfire transducer 56B, FIG. 4, measures negative pressure in the lower portion of the combustion chamber 28B and is proportionally controlled by the induced draft damper 57 in response thereto to maintain the negative pressure, in practice in the 0.02 to 0.04 range (water gauge).
3. Belt and fuel feed values are established at 100% rated boiler output.
4. Overfire air volumes are established.

At this time air velocities are measured by analog sensors for the underfire air and overfire air. These values are converted via the computor CFM's and directly displayed on the access windows. The EPROM retains, based on the fuel selected full rated CFM, and the proportional value of combustion air at 25% rated boiler output. The computer by reading velocities can effectively control air volumes by controlling the appropriate proportional dampers.

E. Upon reaching the operating limit of the boiler in temperature or pressure, the computer automatically adjusts the operation of the following to insure proper operating limits.

Belt Travel—reduce
Fuel Feed Rate—reduce
Underfire Air—reduce
Induce Draft—Adjust to established value.

The computer has full proportional control down to 25% of rated boiler output, and can effectively monitor and control the system to insure proper combustion while not exceeding operating limits.

F. During the operation of the system the computer is constantly receiving signals from all the sensors as outlined by the flow chart and DOC list. These values may be assessed by a personal computer with the appropriate program to act as a datalogger at a selected interval.

G. The system may be switched to oil burner operation controlled by the computer in the event that the fire expires. The computer receives a signal for operation by noting temperature and pressure. In addition a thermocouple in the combustion zone signifies that the solid fuel system is operating. If the fire has expired the thermocouple sensor 28C below the port 45, FIG. 4, via the computer starts the following sequences.

1. Underfire air system is off.
2. Overfire air system is off.
3. The induced draft fan continues operation.
4. I.D. damper is adjusted to its original draft setting.
5. Hydraulic system is off.
6. The oil burner is on for the selected mode.

The boiler now operates off the computer inputed values for safety and operation and is backed by the redundant controls. The system will continue to cycle on oil as is required by the hi-lo or full modulation principle depending on the requested boiler output.

H. The computer also controls and monitors up to eight independent zones for steam or hot water distribution. Eight analog sensors feed the computer for zone dry bulb readings and operates relays and contact closures to function valves or solenoids.

In addition to the above the computer EPROM provides for memory access to program set-backs and holiday schedules for each of the individual zones.

I. The outside temperature is monitored by any analog sensor and the computer can provide an operating hysteresis to lower boiler operating temperature or pressure when the outside conditions become moderate.

J. The microprocessor is also capable of monitoring fuel levels in several bins or silos and effectively control the flow of materials from each unit independently or in established ratios to the fuel metering hopper.

K. The microprocessor is capable of analyzing all the system diciplines including electrics, fuel flow, air flow and other DOC variates. Status and failure modes are displayed on the front panel to aid operator interface.

In connection with the foregoing, the following are channel assignments of the computer for the inputs and outputs not all of which have been illustrated by the drawings.

INPUT.DOC

There are 40 input channels numbered 0–39. Channels 0–15 are via ADC1, 16–31 are via ADC2, 32–35 are via PPI1 port C upper nibble, 36–39 are via PPI3 port C nibble.

| Var. # | Ch. # | |
|---|---|---|
| 0 | CH0 | Water temperature (AD590). |
| 1 | Ch1 | Return temperature (AD590). |
| 2 | Ch2 | Outdoor temperature (AD590). |
| 3 | Ch3 | Boiler room temperature (AD590) |
| 4 | Ch4 | Zone temperarure 1 (AD590). |
| 5 | Ch5 | Zone temperature 2 (AD590). |
| 6 | Ch6 | Zone temperature 3 (AD590). |
| 7 | Ch7 | Limit switch 1 (SW) |
| 8 | Ch8 | Limit switch 2 (SW). |
| 9 | Ch9 | Limit switch 3 (SW). |
| 10 | Ch10 | Circulator 1 (SW). |
| 11 | Ch11 | Circulator 2 (SW). |
| 12 | Ch12 | Circulator 3 (SW). |
| 13 | Ch13 | Aux burner switch (SW). |
| 14 | Ch14 | Emergency switch (SW). |
| 15 | Ch15 | Over-fire airspeed. |
| 16 | Ch16 | Limit switch 4 (SW). |
| 17 | Ch17 | UF blower current. |
| 18 | Ch18 | OF blower current leg 1. |
| 19 | Ch19 | ID blower current leg 1. |
| 20 | Ch20 | OF blower current leg 2. |
| 21 | Ch21 | ID blower current leg 2. |
| 22 | Ch22 | OF blower current leg 3. |
| 23 | Ch23 | ID blower current leg 3. |
| 24 | Ch24 | Water pressure. |
| 25 | Ch25 | Over-fire draft pressure. |
| 26 | Ch26 | Oxygen sensor. |
| 27 | Ch27 | Chute temperature (TC). |
| 28 | Ch28 | Stack temperature (TC). |
| 29 | Ch29 | Furnace temperature (TC). |
| 30 | Ch30 | UF airspeed. |
| 31 | Ch31 | Not used. |
| 32 | Ch32 | Drive pressure (SW). |
| 33 | Ch33 | Low water (SW). |
| 34 | Ch34 | High water (SW). |
| 35 | Ch35 | Level control pressure switch (SW). |
| 36 | Ch36 | Fireomatic switch (SW). |
| 37 | Ch37 | Door interlock switch (SW). |
| 38 | Ch38 | Ash bin level switch (SW). |
| 39 | Ch39 | Fuel bin level switch (SW). |

-continued

| INPUT.DOC | |
|---|---|
| There are 40 input channels numbered 0–39. Channels 0–15 are via ADC1, 16–31 are via ADC2, 32–35 are via PPI1 port C upper nibble, 36–39 are via PPI3 port C nibble. | |
| Var. # | Ch. # |
| Variable numbers 40–63 are reserved for future inputs. | |

| OUTPUTS.DOC | | |
|---|---|---|
| Digital outputs are SSR0–SSR15. SSR0–SSR7 are via PPI1 (Port A). SSR8–SSR15 are via PP13 (Port A. Analog outputs are via PPI1 port B (Data) and C (address and control). | | |
| Var # | Ch. # | Device |
| Solid state variable number and channel assignments are as follows: | | |
| 80 | SSR0 | Under-fire fan. |
| 81 | SSR1 | Over-fire fan. |
| 82 | SSR2 | Induced draft fan. |
| 83 | SSR3 | Oil burner. |
| 84 | SSR4 | Screw feed. |
| 85 | SSR5 | Not used. |
| 86 | SSR6 | Grate feed. |
| 87 | SSR7 | Not used. |
| 88 | SSR8 | Hydraulic pump. |
| 89 | SSR9 | Silo to feed bin screw. |
| 90 | SSR10 | Ash bin cleaner. |
| 91 | SSR11 | Fuel bin spray. |
| 92 | SSR12 | Audible alarm. |
| 93 | SSR13 | Not used. |
| 94 | SSR14 | Not used. |
| 95 | SSR15 | Not used. |
| Analog variable number and channel assignments are as follows: | | |
| 96 | Ch0 | Induced-draft damper. |
| 97 | Ch1 | Under-fire damper. |
| 98 | Ch2 | Under-fire damper - Sensed oxygen. |
| 99 | Ch3 | Not used. |

Figure 18A:
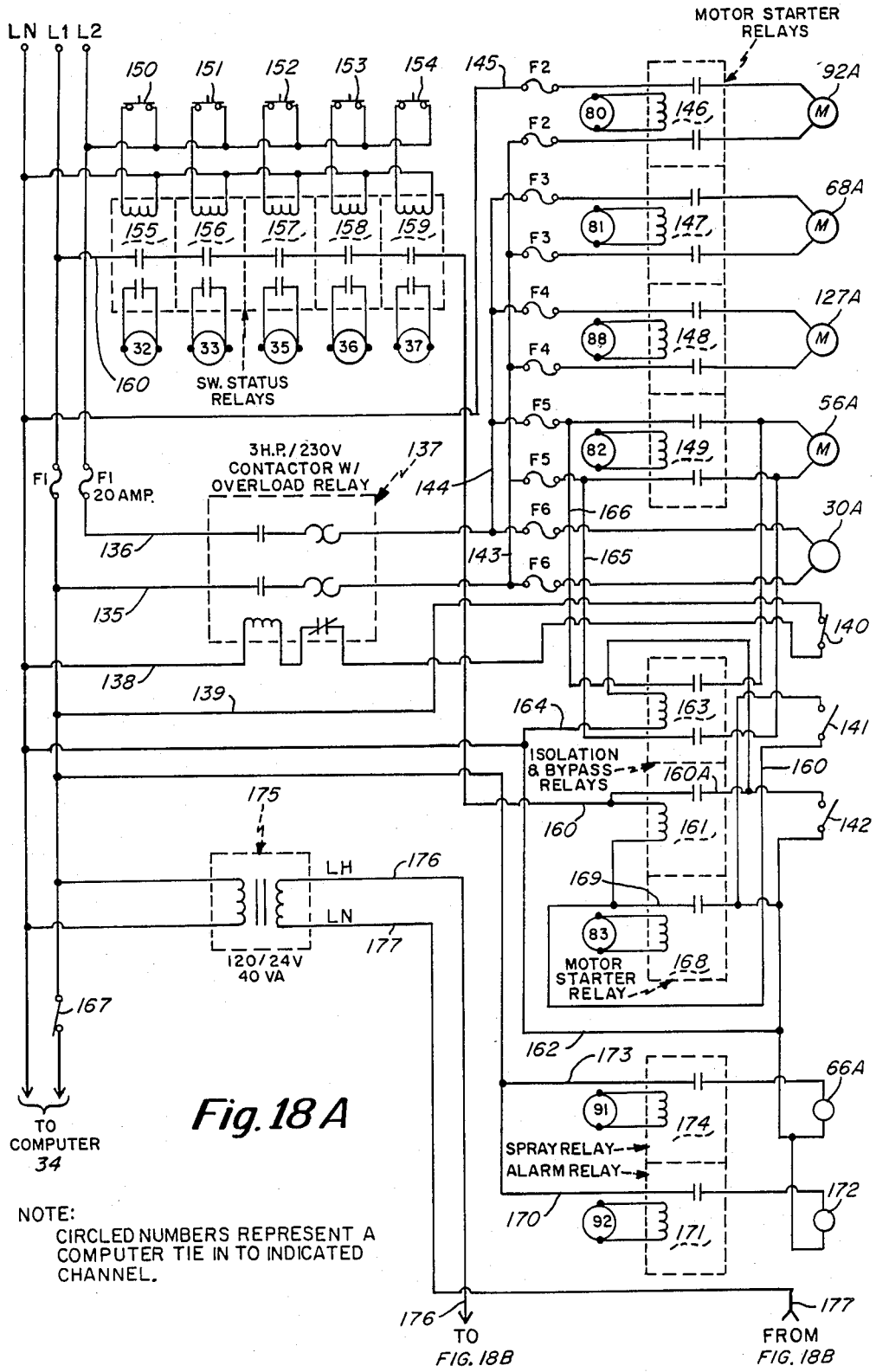
FIG. 18A is a schematic view of the circuitry including the several motors.

The circuitry controlling the operation of the several motors is schematically shown in FIG. 18A. L1 and L2 have parallel leads 135 and 136, respectively, which are provided with the normally open switches of a relay 137 located in the LN lead 138 which also has the normally closed switch of the relay. The lead 138 and an L1 lead 139 are controlled by a manually operated emergency switch 140. The leads 135 and 136 also supply power to the oil burner motor 30A (or open the valve of a gas burner) if either the manually operated switch 141 or the parallel switch 142, controlled by the computerized microprocessor 34, is closed.

Branch leads 143 and 144 provide power to operate the motor 92A of the underfire air blower 92, the motor 68A of the overfire air blower, the motor 127A of the pump 127 of the hydraulic system, and the motor 56A of the induced draft fan 56. The motors are connected in parallel to the lead 143 with the motor 92A connected to LN by a lead 145 and the other motor connected to the lead 144. The leads to each motor are provided with the normally open switches of a relay in a control circuit which may be manually operated but in the disclosed embodiment are controlled by outputs of the computerized microprocessor 34. The relay 146 is in control of the motor 92 and is energized in response to a channel 80 output. The motor 68A is under the control of the relay 147 and is energized in response to outputs of channel 81. The motor 127A is operated when the relay 148 is energized as it is in response to outputs of channel 88 and the motor 56A is operated when the relay 149 is energized in response to outputs of channel 89.

No operation of the gas or oil burner or of the above motors is possible unless safe operating conditions prevail. To that end a series of normally open switches 150, 151, 152, 153, and 154 are connected in parallel to L2 and LN and, these when closed energize relays 155, 156, 157, 158, and 159, respectively and each has a normally open switch in an L1 lead 160 and a normally open switch in a circuit providing an output to the computerized microprocessor 34. By way of examples, when the relay 155 is energized, an output to channel 32 is provided that a certain safe operating condition exists, when the relay 156 is energized, the boiler water level is within safe limits, outputs to channel 33 are provided when the relay 157 is energized, outputs to channel 35 result, when the relay 158 is energized, outputs to channel 36 establish that another safe operating condition exists and when the relay 159 is energized, outputs to channel 37 establish that safe operating conditions for the use of the burner 30.

If the burner 30 is to be manually operated, and safe operating conditions exist, the relay 161 in the lead 160 is energized closing its normally open switch in the branch lead 160A to one side of the burner switch 142. The lead 160 also includes the corresponding side of the parallel, manually operated burner switch 141. The other side of each of the switches 141 and 142 is connected to an LN lead 162.

The branch lead 160A has a relay 163 and has an LN connection 164. The two leads which are connected to the motor 56A of the induced draft fan 56 have bypass leads 165 and 166 provided with the normally open switches of the relay 163 thus enabling the motor 56A to be operated independently of the relay 149. If the manually operated switch 141 is closed, the burner 30 and the induced draft fan 56 are operated as long as safe operating conditions exist.

If a solid fuel fire is established, the computerized microprocessor 34 is placed in service by closing the manually operated switch 167 and the several motors are placed in service in response to the outputs of channels 80, 81, 88 and 82. The relay 168, energized in a response to a channel 83 output, closes its normally open switch in a lead 169 connected to the LN lead 162 thus rendering manual operation of the burner 30 impossible.

A L1 lead 170 is provided with the normally open switch of a relay 171 in a control circuit energized in response to a dangerous operating condition by an output of channel 92, an overly high temperature in the chute 29, for example, with the lead 170 then closed to the LN lead 162 through the alarm 172 which is preferably of an audible type. Another L1 lead 173 has the normally open switch of the relay 174 in a control circuit energized by the output of channel 91 to complete the circuit to the lead 162 through the solenoid operated valve 66A then to discharge spray into the chute 29.

Figure 18B:
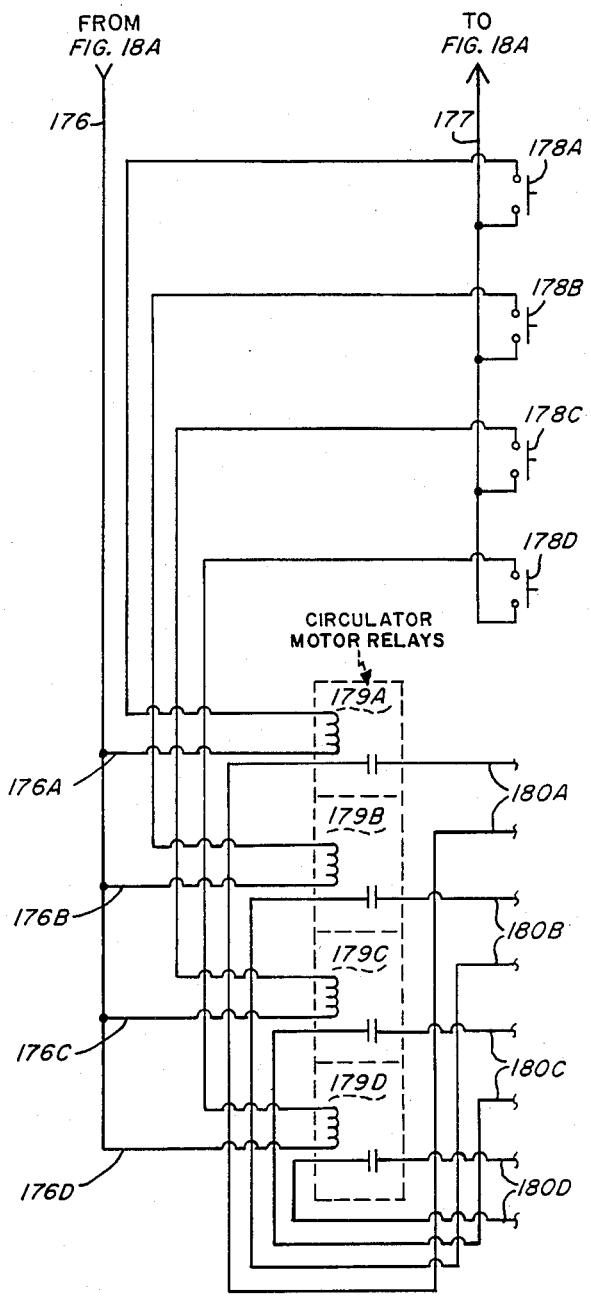
FIG. 18B is a schematic view of the circuitry which includes the circulators.

Ll and L2 are connected to a transformer 175 having a lead 176, see FIG. 18B, provided with branch leads 176A, 176B, 176C and 177D each connected to the LN line 177 through the appropriate one of the thermstatically controlled switches 178A, 178B, 178C, and 178D and the corresponding one of the relays 179A, 179B, 179C, and 179D. Parallel circulator control circuits 180A, 180B, 180C, and 180D are provided and each includes the normally open switch of the appropriate one of the relays 179A, 179B, 179C, and 179D thus to ensure the wanted temperature where needed as determined by the thermostats.

Figures 19A, 19B:
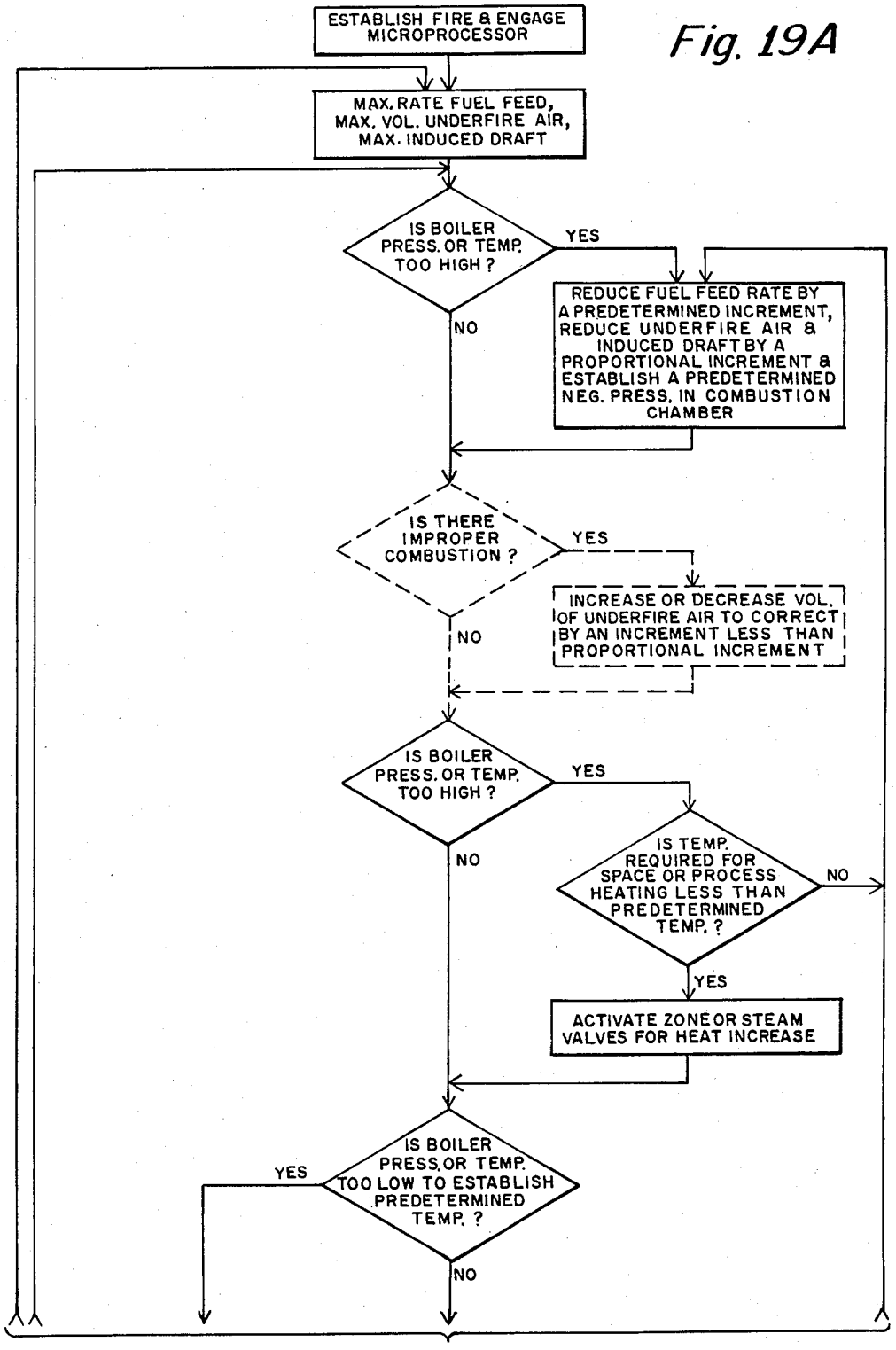
FIGS. 19A and 19B show a flow chart of the first main program.
Figure 19A:
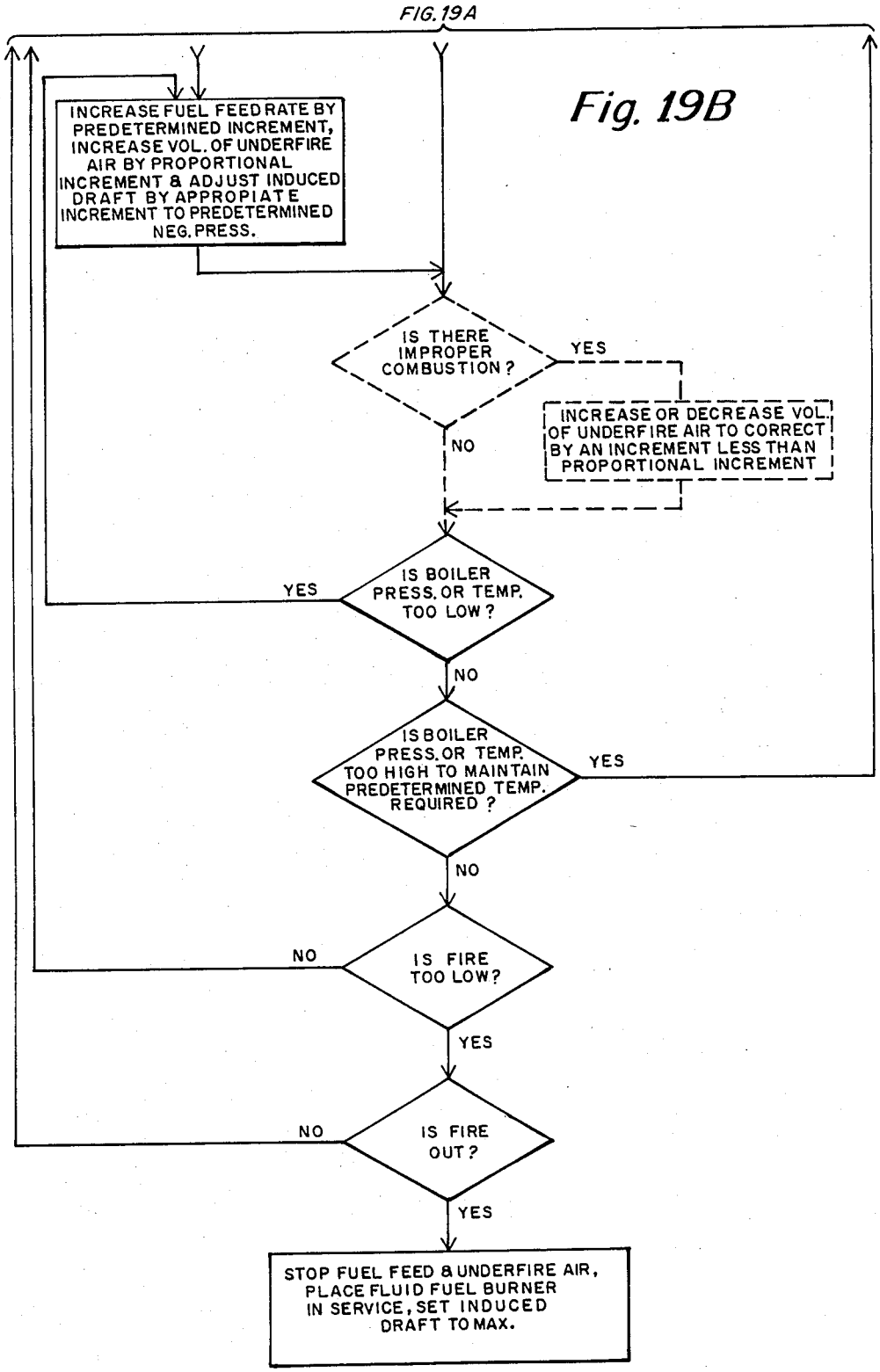
Figures 20A, 20B:
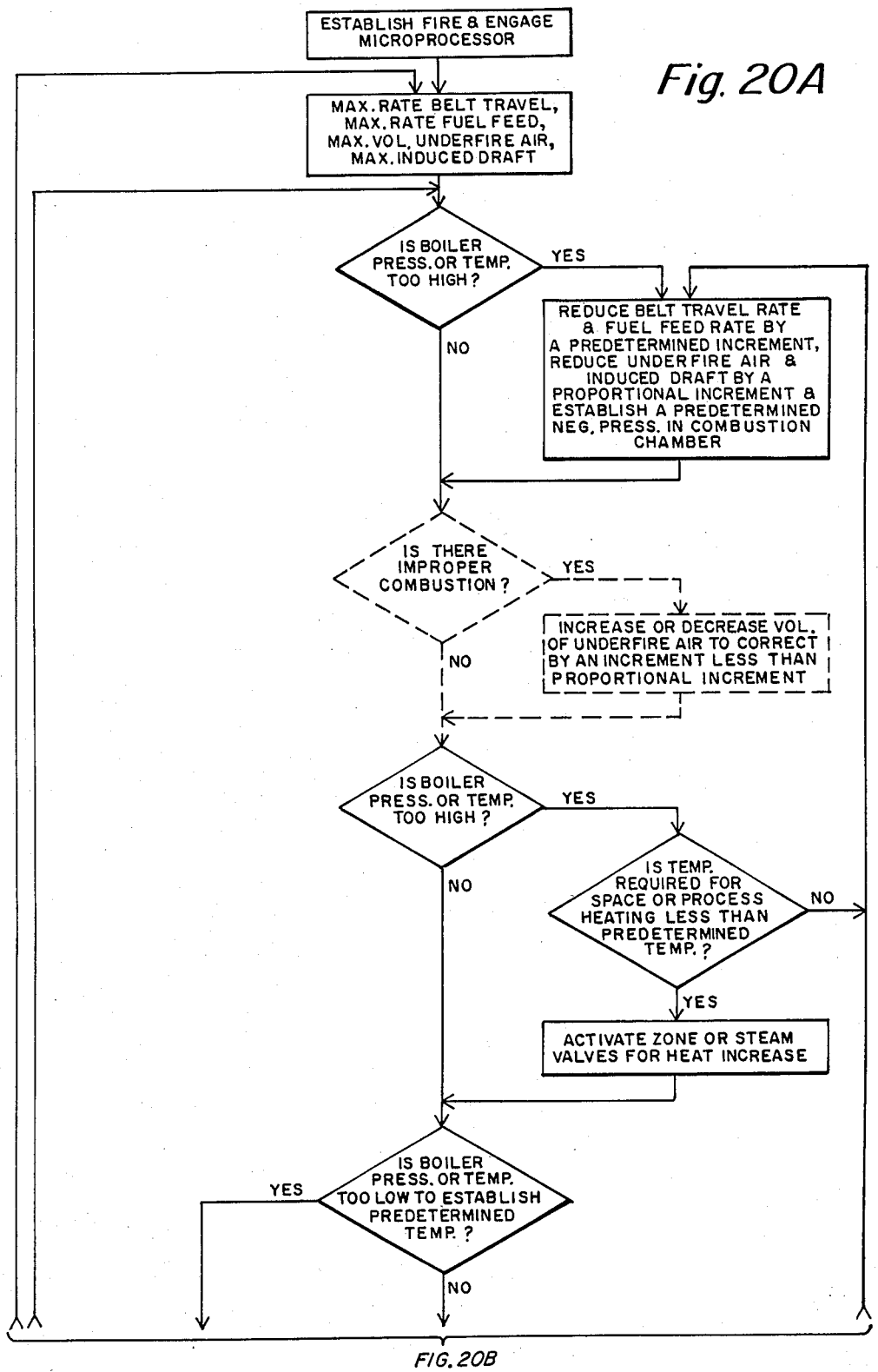
FIGS. 20A and 20B show a flow chart of the second main program.
Figure 20A:
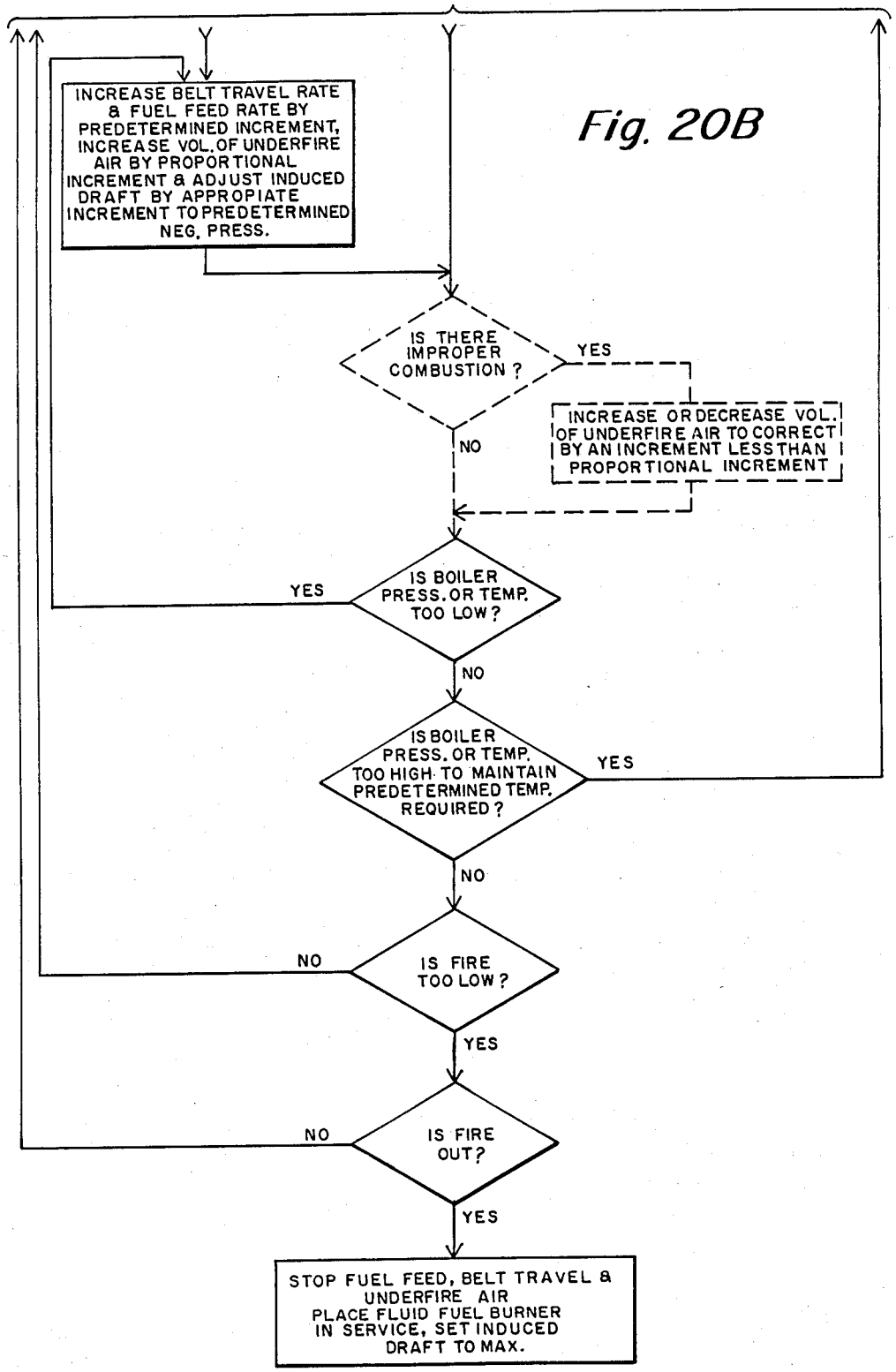

From the foregoing and the two main programs of FIGS. 19 and 20, the construction of the boiler 25 and its operation will be apparent.

We claim:

1. An automatic stoker boiler for space or process heating with steam or hot water, said boiler including a heat transfer compartment having a water inlet and an outlet for steam or hot water, an exhaust, a combustion chamber below said compartment having first and second ends, a transverse partition in said chamber inclined upwardly from the second end and towards but terminating short of the first end to provide a restricted flame and hot gas port and dividing said chamber into upper and lower portions, drive and driven shafts below said chamber, sprockets supported by said shafts, an endless belt of the link type trained about said sprockets and disposed and dimensioned with its upper course forming the grate for the lower portion, means to deliver underfire air upwardly through said upper course, said upper portion having a throat opening adjacent said second end, heat exchanging passageways extending through said compartment and in communication with said throat and said exhaust, means to deliver overfire air into said chamber from said first end above and below said port, means to deliver solid fuel particles to said upper course adjacent said first end, means in said exhaust operable to induce draft in said upper portion and control means operable to effect the advance of said belt by predetermined increments at a wanted rate, means operable to deliver solid fuel to the upper course in predetermined, proportional increments, means to vary the induced draft by predetermined, proportional increments and means to adjust the underfire air volume by predetermined, proportional increments.

2. The automatic stoker boiler of claim 1 in which the combustion chamber includes a water jacket in open communication with the heat transfer compartment, the partition includes a plurality of reinforcements consisting of conduits extending lengthwise thereof, the lower and upper ends of which are in communication with the interior of the jacket.

3. The automatic stoker boiler of claim 1 and a standby fluid fuel burner in the upper chamber portion and supported by said second end, and the control means is operable to place the standby burner in service if no fire exists in the lower portion of the combustion chamber and prevents the use of the burner if fire is established therein.

4. The automatic stoker boiler of claim 1 in which the fuel supply means includes a chute operable to receive a relatively small supply of fuel and to discharge fuel onto said course as said course advances, a hopper dimensioned to contain a substantially larger supply of fuel, and conveying means of the screw type including a first end portion in said hopper to convey fuel therefrom and a second end portion positioned to discharge fuel into the chute, a hydraulic motor by which said conveying means is operated, and a control to effect the operation of said motor by intervals of a predetermined number of seconds predetermined for the particular fuel or fuel combination being burned in the chamber thereby to deliver fuel to the belt in relatively small increments.

5. The automatic stoker boiler of claim 4 and means responsive to a predetermined build up of fuel in said chute and then operable to prevent the operation of said control means.

6. The automatic stoker boiler of claim 4 in which the solid fuel delivery means includes a plurality of bunkers, each for a supply of different solid fuel particles, and means to deliver solid fuel particles from one or more bunkers to the hopper.

7. The automatic stoker boiler of claim 1 in which the means to deliver underfire air includes a blower and a damper in control of its output, the means in the exhaust operable to create an induced draft includes a fan and a damper in control of the fan intake, and a control operable to adjust the dampers, the belt travel and fuel feed rates in directions and by proportional increments determined by boiler temperature and pressure, outdoor temperature and the relation of the temperature available for the space or process heating to a predetermined temperature desired therefor.

8. The automatic stoker boiler of claim 7 and means in the exhaust operable to detect a gas indicative of improper combustion conditions and then to effect adjustments of the underfire air volume by adjusting the underfire air damper by increments less than the predetermined adjustments thereof effected with adjustmsnts of the induced draft damper.

9. The automatic stoker boiler of claim 1 in which the means delivering underfire air through the belt includes a plurality of plenums spaced lengthwise of and below the upper course of the belt with each plenum opening directly against the upper course and each plenum includes a damper, each of which is adjustable independently of any other.

10. The automatic stoker boiler of claim 1 in which the fuel supply means includes a chute disposed to discharge fuel onto said belt course as the belt advances, and a water supply conduit includes a normally closed valve and a spray device in the chute, a heat sensor within the chute and means responsive to a sensed temperature therein above a predetermined maximum and then operable to open said valve.

11. The automatic stoker boiler of claim 7 in which the belt advancing means includes a pawl and ratchet connection with the drive shaft, a fluid pressure operated piston-cylinder unit is operable to effect the operation thereof and a fluid pressure delivery conduit in communication with said unit includes a valve means operated by said control.

12. The automatic stoker boiler of claim 7 and a control mounted in the rear of the upper portion of the combustion chamber is operable when no fire exists in the lower portion to stop the delivery of underfire and overfire air, the belt advancing and the fuel feeding means and places the fluid fuel burner in service along with the operation of the means establishing the induced draft.

13. The automatic stoker boiler of claim 7 in which the control includes a computerized analog and digital microprocessor programmed to respond to one or more inputs representing changes in boiler temperature or pressure, outdoor temperature and the relation of the temperature available for space or process heating in relation to the temperature desired therefor then to effect said adjustments as long as an established fire exists.

14. Apparatus for advancing solid fuel particles through the combustion chamber of a stoker boiler, said apparatus including a base below said chamber, drive and driven shafts in said base, at least two sprockets supported by each shaft and an endless link belt trained about said sprockets with its upper course the bottom of the chamber and operable to receive and convey fuel through said chamber, means supporting the upper course of the belt, means supporting the lower course thereof, said belt consisting of drive and plain links arranged in first and second groups which alternate throughout the length of the belt, all of said links provided with a central, laterally disposed projection the extent of each of which is slightly in excess of the link width, each drive link includes a tooth at each end, both groups having at least two drive links and a plurality of plain links, the links of the first group all disposed with their projections extending in the same direction thus providing gaps between the ends of the links and the links of the second group having their projections all disposed in the opposite direction thereby to enable the ends of the links of any group to be freely fitted in the gaps of the adjacent groups thus to provide narrow passageways for underfire air, pivot rods interconnecting the interfitted ends of all of the links and the drive links of the two groups so located that corresponding ones engage the same sprockets, and drive means connected to said drive shaft to effect the advancing of said belt.

15. The apparatus of claim 14 in which the width of each drive link and the extent of its projection is slightly more than twice the width of each plain link and the extent of its projection.

16. The apparatus of claim 14 in which the drive links are the side links of each group.

17. The apparatus of claim 16 in which each shaft has side sprockets and a central sprocket and each group contains a central drive link and a plurality of plain links between each side link and said central link.

18. The apparatus of claim 14 in which the extremity of the projection of each link has an open ended channel disposed normal to the load supporting surface of each link.

19. The apparatus of claim 14 in which the base has side supports for the margins of the upper course of the belt, a support for the lower course thereof and side guides, the pivot rod ends extend beyond the side links, and side supporting means surrounding margins of the path of the belt and engageable by the pivot rod ends and prevent unwanted lateral movement thereof.

20. The apparatus of claim 14 in which the sides of the base are provided with supports overlying the margins of the upper course of the belt and include front and rear end portions, a front plate is supported by the front end portion and overlies one shaft and the sprockets thereon, an ash plate is supported by the rear end portion and overlies the other shaft and the sprockets thereon and refractory brick assembled on the portion of the supports intermediate said end portions, said ash plate arcuate in cross section and so supported by said end portions as to block the passage of ashes across it until they have accumulated to a predetermined level on its upstream side.

21. The apparatus of claim 20 in which the means supporting the upper course of the belt assembly are supported by the sides of the base and including a grid portion between the end plates of the support, said assembly supported in a position in which the portion of the upper course of the belt between the shafts and the sprockets thereon is supported by the grid portion.

22. The apparatus of claim 21 in which adjustable dampers are spaced lengthwise of the grid portion and are operable to effect the distribution of underfire air lengthwise thereof in a wanted manner and said assembly includes end portions which block the flow of underfire air into the combustion chamber except through the damper controlled grid portion.

23. The apparatus of claim 22 and a side guide assembly at each side of the belt and supported by the air control assembly and the means supporting the lower course of the belt, said assemblies holding said belt against lateral movement.

24. The apparatus of claim 22 and a blower operable to deliver underfire air into said base and including an adjustable damper in control of the volume of air delivered therein by the blower and a control to adjust said damper either to increase or decrease said volume in predetermined increments.

25. The apparatus of claim 14 in which a blower is supported by the base and is operable to deliver underfire air into the base, and a series of plenums extending lengthwise of the upper course of the belt and fitted between the path of the teeth of the drive links, shields supported by the base overlying the sprockets and the remainder of said upper course, an adjustable damper connected to the undersurface of each plenum to control the amount of underfire air passing therethrough and the upper surface of each plenum is provided with spaced members supporting said upper course.

26. The apparatus of claim 19 and an adJustable damper in control of the air delivered into the base by said blower.

27. The apparatus of claim 26 and means to deliver solid fuel particles onto said upper course, said means including a fuel chute operable to discharge fuel onto said course as said course advances, a hopper dimensioned to accommodate a substantial supply of fuel, and means of the screw type operable to deliver fuel into said chute from said hopper for predetermined intervals to establish fuel additions in predetermined increments.

28. The apparatus of claim 27 in which belt drive means is operable to effect belt travel in predetermined increments and a control is operable to vary the frequency of said increments and those of the fuel feeding means in directions depending on whether the combustion rate is to be increased or decreased.

29. An automatic stoker boiler for providing by steam or hot water the required temperature for space or process heating, said boiler including a combustion chamber, first means to feed solid fuel particles into and through said chamber at adjustable rates, a heat exchange compartment above said chamber and provided with a water inlet, a steam or hot water outlet and an exhaust, a heat exchanging passageway through the compartment effecting communication between the chamber and the exhaust, second means in said exhaust to induce an overfire draft to establish a predetermined negative pressure in said chamber, said second means including a fan and an adjustable damper on the intake side thereof, third means operable to deliver underfire air into said chamber and including a blower and an adjustable damper in control of the blower output to vary the volume of underfire air, first sensing means responsive to boiler temperature or pressure, second sensing means responsive to the negative pressure in the chamber, third sensing means responsive to outdoor temperatures, fourth sensing means responsive to the temperature provided for space or process heating in relation to the temperature required therefor, and control means operable to effect proportional adjustments of said dampers and the fuel feed rate in directions determined by whether combustion rates need to be increased or decreased relative to maximum temperature or pressure limits and the temperature required for space or process heating.

30. The automatic stoker boiler of claim 29 in which the control means is a computerized digital and analog microprocessor, each damper is adjustable by predetermined increments and the fuel feed rate is adjustable by a predetermined increment, all of said increments proportional one to the other.

31. The automatic stoker boiler of claim 29 in which there is a fifth sensing means in the exhaust capable of detecting the presence of a gas indicative of improper combustion conditions and the control responds thereto and effects appropriate adjustments of the underfire air volume by increments less than those effected when combustion rates are to be increased or decreased.

32. The automatic stoker boiler of claim 30 in which the fuel feeding means include a chute in communication with the combustion chamber and a substantial supply, means to deliver fuel from the substantial supply to the chute in predetermined increments, means to sense an excess of fuel in said chute and the control responds thereto to halt fuel delivery thereto until said excess is removed.

33. The automatic stoker boiler of claim 32 and a spray nozzle within the chute, means to sense the temperature within the chute and means operable to respond to a sensed temperature that is above a predetermined temperature then to deliver water to said nozzle.

34. The automatic stoker boiler of claim 30 in which the fuel feed means also includes a belt by which the fuel is carried through the combustion chamber and which receives fuel from the chute as it moves, means to effect belt travel by predetermined increments and said control is operable to effect such movements and the frequency thereof.

35. The apparatus of claim 14 in which the belt drive means includes a pawl and ratchet connection with the drive shaft, a hydraulic circuit including a piston-cylinder unit connected to the pawl of the connection and operable, when reciprocated to effect the advance of the belt by a predetermined increment, the hydraulic circuit includes a solenoid operated valve means operable to control the flow of fluid to and from said unit in either direction, an electric circuit includes the solenoid of said valve, and a control operable to close and open said electric circuit.

36. The apparatus of claim 29 and the control is a computerized microprocessor to effect the opening and closing of the electric circuit at frequencies determined by the wanted combustion rate.

37. The apparatus of claim 27 in which the fuel feeding means includes a hydraulic circuit provided with a hydraulic motor and a solenoid operated valve, and a control circuit includes said solenoid and timing means by which the solenoid circuit is closed for a predetermined interval thereby to effect fuel delivery to the chute in predetermined intervals.

38. The apparatus of claim 37 in which the timed interval depends on the type of fuel being burned and is within the approximate range of three to ten seconds.

39. The apparatus of claim 38 and the control is a computerized microprocessor programmed to effect the opening and closing of the solenoid circuit at a frequency proportional to the rate at which the belt is advanced.

40. The automatic stoker boiler of claim 29 and a hydraulic motor, reversible fluid pressure operated means operable to effect underfire air volume adjustments, a reversible fluid pressure operated means operable to effect induced draft volume adjustments, hydraulic circuits, one for each of said fluid pressure operated means, including solenoid operated valve means operable to effect the opening and closing thereof in a manner such that the belt drive rate, the fuel feed rate, the underfire air volume and the induced draft volume are adjusted relative to each other by predetermined proportional increments.

41. The automatic stoker boiler of claim 29 in which the adjustable damper in control of the underfire air volume and the adjustable damper in control of the induced draft each include a fluid pressure operated piston-cyinder unit and solenoid operated valve means operable to block or permit fluid pressure to be delivered to either end of the cylinder of the unit and to be removed from the other end thereof.

42. The automatic stoker boiler of claim 41 and a computerized microprocessor programmed to respond to inputs representing the need of damper adjustments to provide outputs controlling the circuitry to effect the delivery of fluid under pressure for an appropriate interval to attain the wanted proportional incremental damper adjustment.

43. The automatic stoker boiler of claim 42 in which a sensor in the exhaust is of a type capable of detecting a gas indicative of improper combustion conditions and the computerized microprocessor is programmed to receive inputs from the sensor as to the presence of the gas and outputs in control of the circuitry to effect valve operation for shorter intervals.

* * * * *